US008733031B2

(12) United States Patent
Knight, III et al.

(10) Patent No.: US 8,733,031 B2
(45) Date of Patent: May 27, 2014

(54) ATTACHMENT MEMBER AND SUPPORT STRUCTURE FOR SUPPORTING A STRUCTURAL BUILDING COMPONENT

(75) Inventors: Stephen J. Knight, III, Littleton, CO (US); William E. Kugler, Denver, CO (US); Scott Wilson, Brighton, CO (US)

(73) Assignee: United Construction Products, Inc., Denver, CO (US)

( * ) Notice: Subject to any disclaimer, the term of this patent is extended or adjusted under 35 U.S.C. 154(b) by 0 days.

(21) Appl. No.: 13/482,849

(22) Filed: May 29, 2012

(65) Prior Publication Data

US 2013/0318907 A1 Dec. 5, 2013

(51) Int. Cl.
*E04B 9/00* (2006.01)

(52) U.S. Cl.
USPC ..... 52/126.5; 52/263; 248/188.6; 248/346.3; 248/174

(58) Field of Classification Search
USPC ..... 52/126.1, 126.4, 126.5, 126.6, 126, 7, 52/98, 100, 263, 299, 220.1, 241, 242, 52/127.1, 127.2, 272, 289, 713–715, 20; 248/188.1, 188.2, 188.5, 188.6 X, 248/188.8, 246.01, 346.06, 346.3 X, 158, 248/174 X; 404/26; 14/2.4, 73
See application file for complete search history.

(56) References Cited

U.S. PATENT DOCUMENTS

| | | | | |
|---|---|---|---|---|
| 4,685,258 | A * | 8/1987 | Av-Zuk | 52/126.6 |
| 4,780,571 | A | 10/1988 | Huang | |
| 4,835,924 | A * | 6/1989 | Blacklin et al. | 52/263 |
| 4,982,539 | A | 1/1991 | Hiller | |
| 5,477,649 | A * | 12/1995 | Bessert | 52/263 |
| 5,588,264 | A | 12/1996 | Buzon | |
| 5,765,248 | A * | 6/1998 | Ono | 14/75 |
| 5,791,096 | A * | 8/1998 | Chen | 52/126.6 |
| 5,904,009 | A * | 5/1999 | Huang | 52/126.6 |
| 5,997,209 | A | 12/1999 | Sachs | |
| 6,363,685 | B1 | 4/2002 | Kugler | |
| 6,625,951 | B1 * | 9/2003 | McCarthy | 52/747.1 |
| 7,140,156 | B1 * | 11/2006 | Lowe et al. | 52/263 |
| 7,866,096 | B2 * | 1/2011 | Lee et al. | 52/126.6 |

(Continued)

FOREIGN PATENT DOCUMENTS

| | | |
|---|---|---|
| GB | 0940664 | 10/1963 |
| JP | 11-100978 | 4/1999 |
| JP | 2002-161632 | 6/2002 |

OTHER PUBLICATIONS

"Deck Connector System," brochure from Simpson Strong-Tie Company, Inc. (Aug. 2011).

(Continued)

*Primary Examiner* — Brian Glessner
*Assistant Examiner* — Beth Stephan
(74) *Attorney, Agent, or Firm* — Marsh Fischmann & Breyfogle LLP; Jonathon A. Szumny; David F. Dockery

(57) ABSTRACT

An attachment member for securing a structural building component (e.g., joist) to a support pedestal of an elevated building surface assembly. The attachment member includes a central portion and at least one joist support arm attached to the central portion. The central portion includes one or more features that allow it to be secured to a support pedestal, and the at least one support arm includes engagement flaps that can be attached to a structural building component to secure the structural building component to the attachment members, and hence to the support pedestal.

50 Claims, 18 Drawing Sheets

(56) References Cited

U.S. PATENT DOCUMENTS

| | | | | |
|---|---|---|---|---|
| 7,921,612 | B2 | 4/2011 | Knight, III et al. | |
| 8,490,342 | B2 * | 7/2013 | Greaves | 52/126.5 |
| 2002/0148173 | A1 | 10/2002 | Kugler | |
| 2002/0194801 | A1 * | 12/2002 | Jette | 52/220.5 |
| 2004/0261329 | A1 | 12/2004 | Kugler et al. | |
| 2005/0055925 | A1 * | 3/2005 | Johansson | 52/390 |
| 2007/0186498 | A1 | 8/2007 | Buzon | |
| 2008/0141601 | A1 * | 6/2008 | Mead | 52/263 |
| 2010/0058679 | A1 | 3/2010 | Greaves | |
| 2011/0011012 | A1 | 1/2011 | Knight, III et al. | |
| 2011/0023385 | A1 | 2/2011 | Knight, III et al. | |

OTHER PUBLICATIONS

"Buzon Batten Support Brochure," Buzon Pedestal International (date unknown).

"Level.It Installation Brochure," United Construction Products, Inc. (2008).

* cited by examiner

ATTACHMENT MEMBER AND SUPPORT STRUCTURE FOR SUPPORTING A STRUCTURAL BUILDING COMPONENT

BACKGROUND OF THE INVENTION

1. Field of the Invention

This invention relates to the field of support structures utilized in construction. In particular, the invention relates to an attachment member for securing a structural building component such as a joist to a support pedestal that supports the building component, such as in an elevated building assembly.

2. Description of Related Art

Elevated building assemblies such as elevated floors, decks, terraces and walkways are desirable in many environments. One common system for creating an elevated building assembly includes a plurality of spaced-apart support pedestals upon which other building components are assembled and are supported above a fixed surface such as above a building roof or other exterior or interior surface. For example, in outdoor applications, a deck may be elevated above a fixed surface by the support pedestals to promote drainage, to provide a level structural surface for walking, and/or to prevent deterioration of or damage to the deck components. The support pedestals can have a fixed height, or can have an adjustable height such as to accommodate variations in the contour of the fixed surface upon which the support pedestals are placed, or to create desirable aesthetic and/or functional architectural features.

One example of a support pedestal is disclosed in U.S. Pat. No. 5,588,264 by Buzon, which is incorporated herein by reference in its entirety. The support pedestal disclosed by Buzon can be used in outdoor or indoor environments and is capable of supporting heavy loads applied by many types of building surfaces. The pedestal includes a threaded base member and a threaded support member that is rotatably engaged with the base member to enable the height of the support pedestal to be adjusted by rotating the support member or the base member relative to the other. The support pedestal can also include a coupling member or extension member that can couple the base member to the support member for further increasing the height of the support pedestal, if necessary.

Elevated building assemblies can include surface tiles (e.g., pavers, wood tiles, etc.) that are supported directly by the pedestals. However, in many applications the building assembly includes joists or similar support components (e.g., battens) that support other building components (e.g., planks) and add rigidity and strength to the building assembly. Standard support components must be adequately attached to the support pedestals to ensure stability of the building assembly. Specifically, in some assemblies, the weight of the surface tiles is sufficient to keep the tiles safely supported by the pedestals.

U.S. Patent Application Publication No. 2007/0186498 by Buzon discloses an elevated floor including boards that are assembled on a framework made up of an arrangement of joists, where the joists are supported above a fixed surface by a number of support pedestals. Each joist can be fixed to the support pedestal through an intermediate component that is fixed to a support pedestal. Each joist can be fixed to the intermediate component and therefore to the support pedestal by inserting pins through perforations in the intermediate component and into a groove that is milled into the joist.

U.S. Patent Application Publication No. 2010/0058679 by Greaves discloses a support for engaging a joist that includes a rotatable plate including two opposed upstanding walls defining a gap therebetween for receiving the joist. Rotation of the rotatable plate causes the walls to abut edges of the joist, where the upright walls include apertures for fastening the joist to the rotatable plate.

SUMMARY OF THE INVENTION

Known support structures for supporting a structural building component (e.g., a load-bearing member) such as a joist are subject to a number of limitations. For example, some support structures require that the joist be milled in a specific manner to be secured to the support structure. As another example, many support structures are not adapted to accommodate diverse sizes of structural building components. More specifically, structural building components such as joists have a variety of sizes such as nominal 4×4 lumber (i.e., 3½"×3½" actual dimensions), nominal 2×4 lumber (i.e., 1½"×3½" actual dimensions), nominal 2×6 lumber (i.e., 1½"×5½" actual dimensions), and the like. Furthermore, some structures may specify the use of two adjacent building components together, such as two nominal 2×4 pieces of lumber. In this regard, existing support structures often fail to adequately accommodate such diverse sizes of structural building components. Further, although such building components are specified to have particular dimensions, very often the actual components vary from these dimensions. For example, a nominal 4×4 lumber may actually have dimensions of 3⅜"×3⅜", rather than the specified 3½"×3½". Still further, many locations in the building support structure require the intersection of structural building components at angles less than 180°, such as about 90°. Many attachment members also do not accommodate such configurations.

It is therefore one objective of the present invention to provide an attachment member and a support pedestal assembly for supporting a structural building component that addresses one or more of the foregoing shortcomings.

According to one embodiment, an attachment member for securing a structural building component to a support pedestal is provided. The attachment member includes a central portion having a top surface and a bottom surface circumscribed by a peripheral edge. At least a first joist attachment structure is affixed to the central portion and extends outwardly from the peripheral edge. The first joist attachment structure includes a first engagement flap disposed at a first end of the first joist attachment structure, and a second engagement flap disposed a second end of the first joist attachment structure opposite the first end. The first and second engagement flaps second are configured to be disposed in a substantially orthogonal position relative to the top surface of the central portion.

In one aspect, the first joist attachment structure may be manipulated to provide a first gap distance between the first and second engagement flaps in the substantially orthogonal position and at least a second gap distance that is greater than the first gap distance. In one characterization, each of the first and second engagement flaps is foldable from a first engagement flap position to the substantially orthogonal position. In one characterization, the first engagement flap position is substantially co-planar with the top surface of the central portion. In another aspect, the first joist attachment structure may include a joist support arm rigidly affixed to the central portion of the attachment member, a first foldable support segment disposed between the joist support arm and the first engagement flap, and a second foldable support segment disposed between the joist support arm and the second engagement flap. Accordingly, the first and second foldable support segments may each include at least a first foldable support segment pivot axis configured to enable the first and second engagement flaps to be folded upwardly along the foldable support segment pivot axes. The engagement flap pivot axes may include grooves extending from a proximal edge of the first joist attachment structure to a distal edge of the first joist attachment structure and that are disposed substantially orthogonally to a longitudinal axis of the first joist attachment structure.

In another aspect, the central portion and the first joist attachment structure may be fabricated as a single unitary structure. In yet another aspect, the first and second engagement flaps are attached to slidable support segments that are linearly slidable along a longitudinal axis of the first joist attachment structure. In one characterization, the first and second engagement flaps are rigidly affixed in the substantially orthogonal position to the slidable support segments. In another characterization, the first joist attachment structure includes a joist support arm rigidly affixed to the central portion of the attachment member, where the joist support arm includes an upper surface that is substantially co-planar with the top surface of the central portion, a lower surface, and a cavity disposed between the upper and lower surfaces. In this regard, the slidable support segments may be at least partially disposed within the cavity.

In another aspect, the attachment member may include a second joist attachment structure that is affixed to the central portion and that extends outwardly from the peripheral edge, where the second joist attachment structure includes a first engagement flap disposed at a first end of the second joist attachment structure, and a second engagement flap disposed at a second end of the second joist attachment structure opposite the first end. The first and second engagement flaps may be configured to be disposed in a substantially orthogonal position relative to the top surface of the central portion. In one characterization, the peripheral edge of the central portion is substantially circular and the first joist attachment structure is separated from the second joist attachment structure by about 180° along the peripheral edge. In another characterization, the attachment member includes at least a third joist attachment structure and a fourth joist attachment structure extending outwardly from the peripheral edge of the central portion.

In another aspect, the first gap distance may be at least about 1 inch and the second gap distance may be at least about 3 inches. In another characterization, the first joist attachment structure may be manipulated to provide at least a third gap distance that is greater than the first gap distance and is less than the second gap distance. According to another aspect, the joist attachment structure may include at least a first fastener aperture disposed in each of the first and second engagement flaps. In another aspect, the attachment member may include a pedestal fastener aperture disposed in the central portion. In another characterization, the attachment member may include an aperture reinforcement rim extending from the bottom surface of the central portion and proximately surrounding the pedestal fastener aperture. In another characterization, the attachment member may include a pedestal alignment rim extending from the bottom surface of the central portion, wherein the pedestal alignment rim has a larger diameter than the aperture reinforcement rim. In another characterization, the attachment member includes at least one clip extending from the bottom surface of the central portion, wherein the clip is configured to attach to a support pedestal when the attachment member is placed on the top surface of the support pedestal. In another characterization, the clip is substantially collinear with the pedestal alignment rim.

In another aspect of the foregoing embodiment, the attachment member is fabricated from plastic. According to another aspect, the attachment member is fabricated from a metal. In yet another aspect, the peripheral edge of the central portion is substantially circular.

According to another embodiment, an attachment member for securing a structural building component to a support pedestal is provided. The attachment member includes a central portion having a top surface and a bottom surface circumscribed by a peripheral edge. At least first and second joist attachment structures are affixed to the central portion, where each of the joist attachment structures includes a first engagement flap disposed at a first end of the joist attachment structure and a second engagement flap disposed at a second end of the joist attachment structure opposite the first end. A first foldable support segment including a first foldable support segment pivot axis is disposed adjacent to the first engagement flap, and a second foldable support segment including a second foldable support segment pivot axis is disposed adjacent the second engagement flap. In this regard, the first and second engagement flaps are upwardly foldable along the first and second foldable support segment pivot axes from a first flap position to a second flap position that is substantially orthogonal relative to the top surface of the central portion.

According to one aspect of this embodiment, the first and second joist attachment structures are disposed on the top surface of the central portion. According to another aspect, the first and second joist attachment structures extend outwardly from the peripheral edge of the central portion. In one characterization, the central portion and the first and second joist attachment structures are fabricated as a single unitary structure. In another characterization, the first and second joist attachment structures are configured to be manipulated to provide a first gap distance between the first and second engagement flaps in the substantially orthogonal position and at least a second gap distance that is greater than the first gap distance. For example, the first gap distance may be at least about 1 inch and the second gap distance may be at least about 3 inches.

In another characterization, the pivot axes comprise grooves that are disposed on a bottom surface of the first and second joist attachment structures. In this regard, each of the foldable support segments may include at least three foldable support segment pivot axes. In another characterization, each of the first and second foldable support segments may include a corrugated surface defining a plurality of foldable support segment pivot axes. In another aspect, the first and second joist attachment structures may include a joist support arm rigidly affixed to the central portion of the attachment member and disposed between the first and second foldable support segments. In another aspect, the attachment member may include at least a first fastener aperture disposed in each of the first and second engagement flaps. In yet another aspect, the attachment member is fabricated from plastic. In yet a further aspect, the attachment member is fabricated from a metal.

In another embodiment, an attachment member for securing a structural building component to a support pedestal is provided. The attachment member may include a central portion comprising a top surface and a bottom surface circumscribed by a peripheral edge. At least first and second joist attachment structures are affixed to the central portion. Each of the joist attachment structures may include a first engagement flap disposed at a first end of the joist attachment structure, wherein the first engagement flap is attached to a first slidable support segment that is linearly slidable along the longitudinal axis of the first slidable support segment. The joist attachment structure also includes a second engagement flap disposed at a second end of the joist attachment structure opposite the first end, wherein the second engagement flap is attached to a second slidable support segment that is linearly slidable along a longitudinal axis of the second slidable support segment. In this regard, the first and second joist attachment structures are configured to be manipulated by linearly sliding the slidable support segments to provide a first gap distance between first and second engagement flaps and at least a second gap distance that is greater than the first gap distance.

In one aspect, the first and second engagement flaps are rigidly affixed in a substantially orthogonal position relative to the first and second slidable support segments, respectively.

In yet another aspect, the first and second joist attachment structures each include a joist support arm rigidly affixed to the central portion of the attachment member, the joist support arm including an upper surface that is substantially coplanar with the top surface of the central portion, a lower surface, and a cavity disposed between the upper and lower surfaces. The slidable support segments may be at least partially disposed within the cavity.

In another embodiment, a support pedestal assembly is provided. The support pedestal assembly may include a support pedestal having a base plate that is configured to be placed on a fixed surface, a support plate that is configured to support a building surface component, and a central section extending between the base plate and support plate. An attachment member is operatively disposed on the support plate, where the attachment member includes a central portion disposed over the support plate and includes a top surface and a bottom surface circumscribed by a peripheral edge. At least first and second joist attachment structures are affixed to the central portion. Each of the joist attachment structures includes a first engagement flap disposed at a first end of the joist attachment structure, and a second engagement flap disposed at a second end of the joist attachment structure opposite the first end. In this regard, the first and second engagement flaps are configured to be disposed in a substantially orthogonal position relative to the top surface of the central portion.

In one aspect, the joist attachment structures may be manipulated to provide a first gap distance between us first and second engagement flaps in the substantially orthogonal position and at least a second gap distance that is greater than the first gap distance. In one characterization, each of the first and second engagement flaps is foldable from a first engagement flap position to the substantially orthogonal position. In another characterization, the first engagement flap position is substantially co-planar with the top surface of the central portion.

According to another embodiment, an elevated building support structure is provided. The elevated building support structure includes a plurality of support pedestals disposed in spaced-apart relation on fixed surface. The support pedestals include a base plate that is placed on a fixed surface, a support plate that supports a structural building component, and a central section extending between the base plate and support plate. An attachment member is disposed on the support plate, where the attachment member includes a central portion having a top surface and a bottom surface circumscribed by peripheral edge and at least first and second joist attachment structures affixed to the central portion. The joist attachment structures include a first engagement flap disposed at a first end of the joist attachment structure and a second engagement flap disposed at a second end of the joist attachment structure opposite the first end. The first and second engagement flaps are disposed in a substantially orthogonal position relative to the top surface of the central portion. A structural building component is secured to the attachment member and supported by the support pedestal, where the engagement flaps are each disposed in a position that is substantially orthogonal to the top surface of the central portion and wherein the first and second engagement flaps are affixed to the building surface component.

In one aspect, the structural building component is a joist. In another aspect, the first and second joist attachment structures include support arms that extend outwardly from the central portion of the attachment member. In yet another aspect, the first and second joist attachment structures are at least partially disposed on the top surface of the central portion of the attachment member. In a further aspect, at least one of the attachment member and the support pedestal is fabricated from plastic. In another aspect, at least one of the attachment member and the support pedestal is fabricated from a metal.

In another embodiment, a method for constructing an elevated building surface assembly is provided. The method may include locating a plurality of support pedestals on a fixed surface in spaced-apart relation, where the support pedestals include a base plate, a support plate and a central section extending between the base plate and the support plate. An attachment member is secured to the support plate, the attachment member including at least first and second engagement flaps. A first structural building component is placed on the attachment member between the first and second engagement flaps and the first and second engagement flaps are moved (e.g., folded or slid) to contact the first structural building component. The first and second engagement flaps are then attached to the first structural building component and building surface components are affixed to the structural building components to form the elevated building surface assembly.

In one aspect, the first structural building component is a joist. In another aspect, the attachment member includes third and fourth engagement flaps and the method further includes the steps of moving the third engagement flap and the fourth engagement flap to bring them into contact with a second structural building component, and attaching the third engagement flap in the fourth engagement flap to the second structural building component. In yet another aspect, the attaching step includes inserting a mechanical fastener through the engagement flaps and into the structural building component(s).

DESCRIPTION OF THE INVENTION

Figure 1:
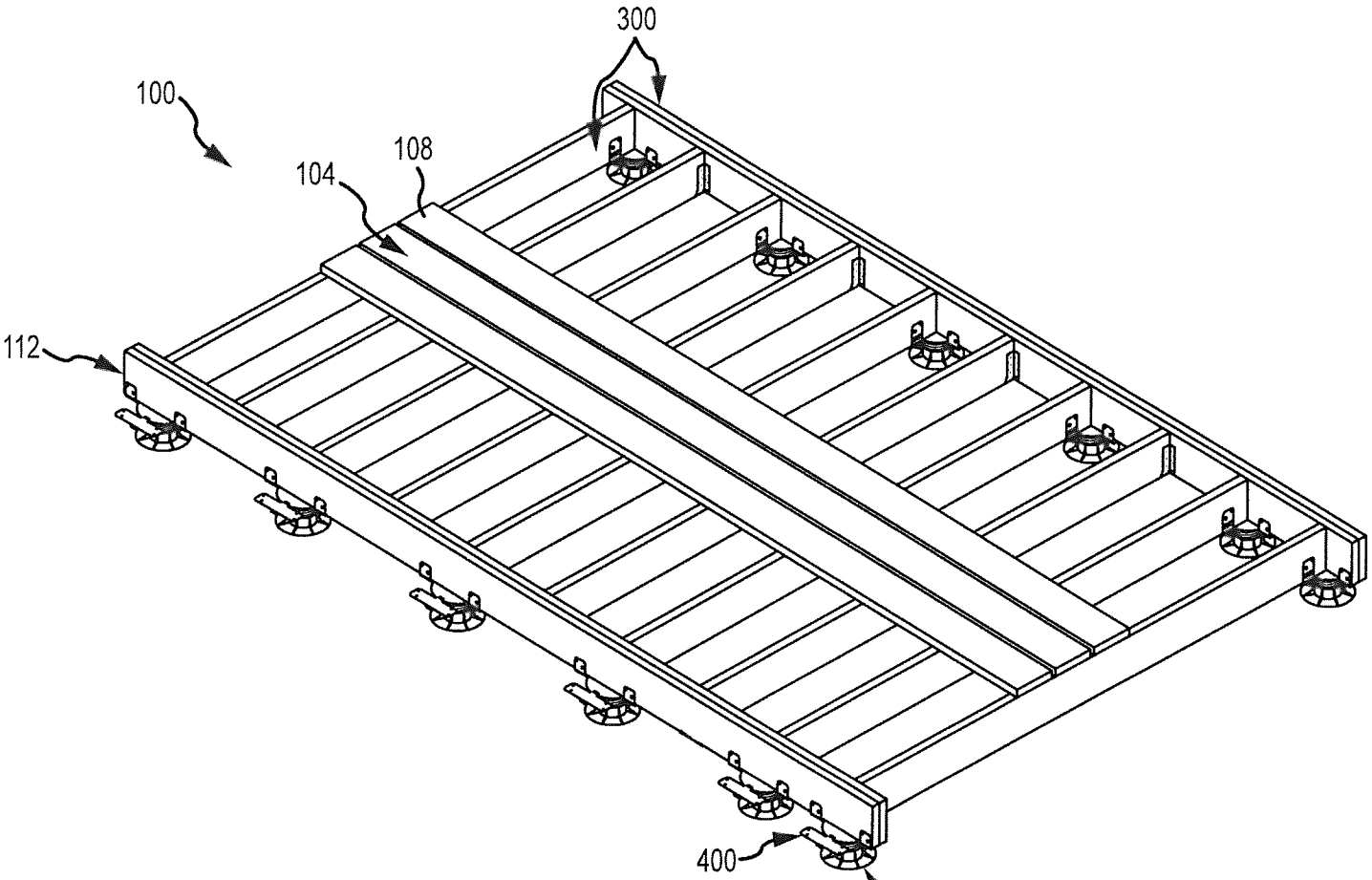
FIG. 1 illustrates a perspective view of a partially assembled elevated building support structure including attachment members, where the attachment members secure structural building components to support pedestals.

FIG. 1 illustrates a portion of a building surface assembly 100 that includes a building surface 104 formed from a plurality of building surface components 108 (e.g., planks, boards) that are elevated above a fixed surface (not shown) by an elevated building surface support structure 112. The support structure 112 includes a plurality of spaced-apart support pedestals 200 and an arrangement of structural building components 300, such as joists that are disposed over the support pedestals 200 for receiving and supporting the building surface components 108 thereover. As used herein, the term "joist" includes any type of structural building component (e.g., an elongate beam, batten, stud, and the like) constructed of any appropriate material(s) (e.g., wood, metals, composites, and the like). Additionally, the support structure 112 includes a plurality of attachment members 400 disposed on the support pedestals 200 that are configured to operatively attach the structural building components 300 to one or more of the support pedestals 200.

Each of the structural building components 300 may be placed over several support pedestals 200 to elevate the building surface 104 above the fixed surface. Although illustrated in FIG. 1 as being laid out in a generally symmetrical pattern (e.g., rectangular), the support pedestals 200 may be laid out in various other configurations as may be dictated by the structural or aesthetic requirements of the building surface assembly 100. The support pedestals 200 can be placed in a spaced-apart relation on fixed surfaces including, but not limited to, rooftops, on-grade (e.g., natural ground), over concrete slabs including cracked concrete slabs, and can be placed within fountains and water features, used for equipment mounts, and the like.

The building surface components 108 can be manufactured from virtually any material from which a building surface (e.g., a walkway, deck, terrace, etc.) is to be constructed. Examples include, but are not limited to, wood, composites (e.g., polymer-based composite), and the like. While the building surface components 108 are illustrated in the form of elongate planks or boards, the present disclosure encompasses other forms and shapes (e.g., square or rectangular) such as tiles, pavers, and the like constructed of any appropriate material (e.g., slate, natural stone, composite, concrete pavers, wood, metal, fiberglass, rubber, and the like). Furthermore, the elevated building surface assembly 100 can be used for both interior and exterior applications.

Figure 2:
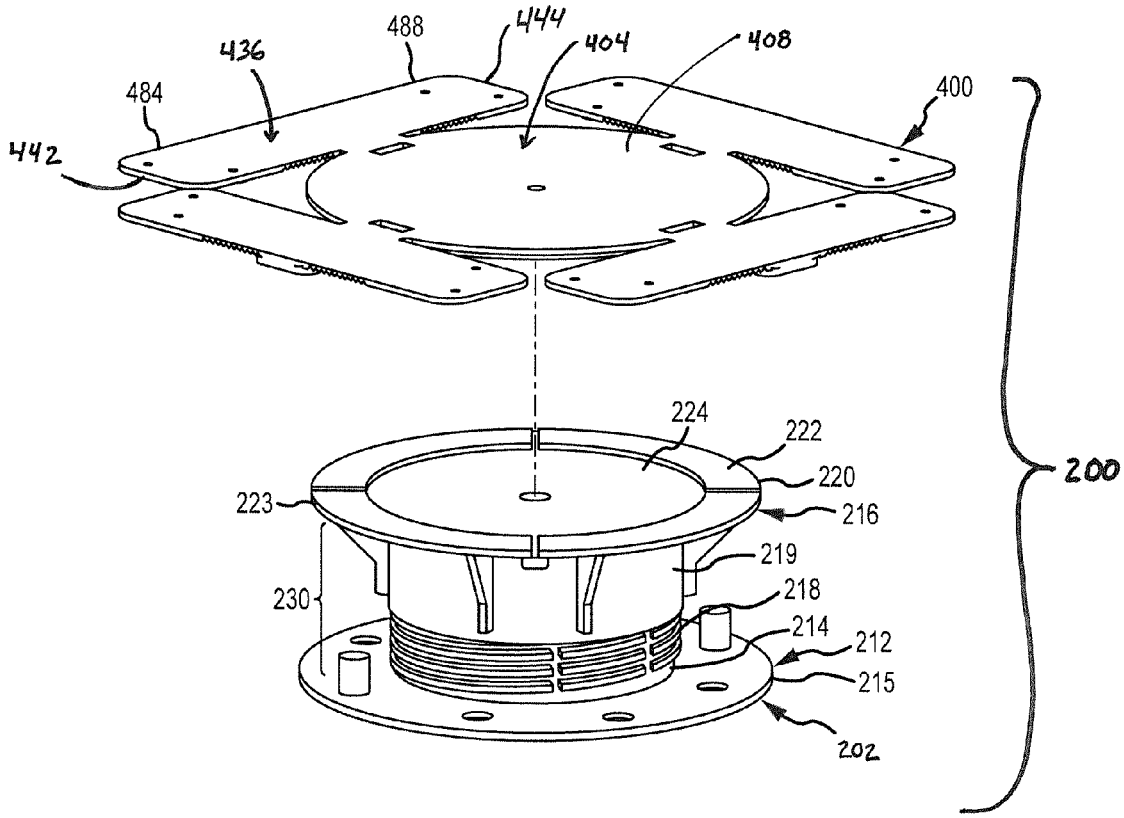
FIG. 2 illustrates an exploded perspective view of a support pedestal assembly that includes an attachment member and a support pedestal.
Figure 3:
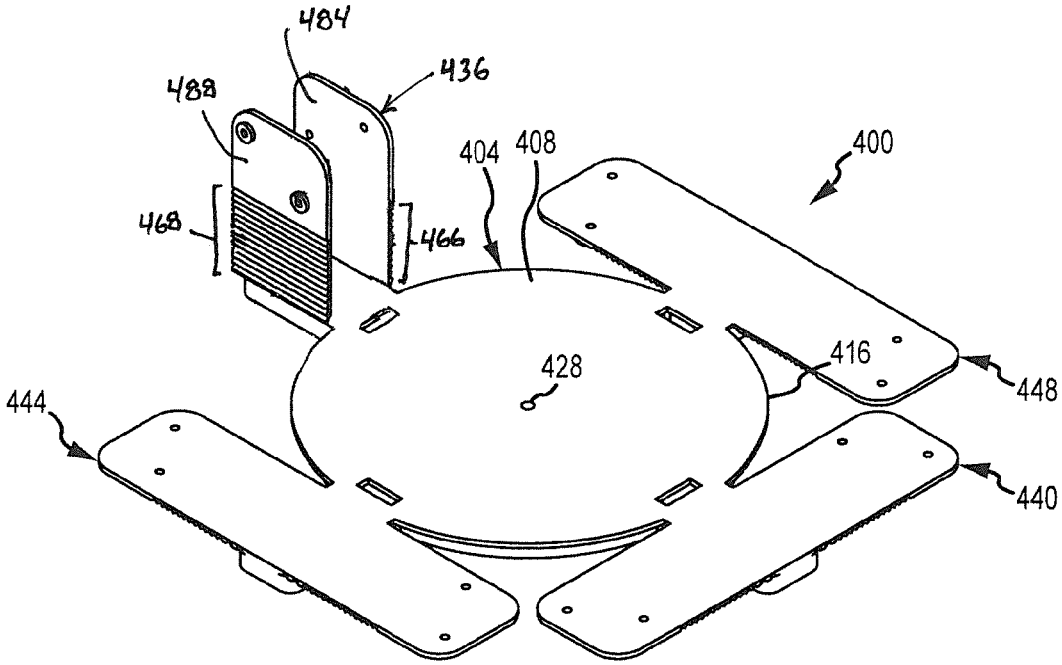
FIG. 3 illustrates an upper perspective view of an attachment member according to one embodiment.

With additional reference now to FIG. 2, an exploded perspective view is illustrated of a support pedestal assembly 200 including a support pedestal 202 and an attachment member 400 disposed over the support pedestal 200, and which may form part of the elevated building surface support structure 112 of FIG. 1. The support pedestal 202 may broadly include a base member 212 including a base member extension 214 (e.g., a cylindrical base member extension) that extends upwardly from a base member plate 215 when the support pedestal 202 is operatively placed on a fixed surface. The base member 212 includes base member threads 218 on a surface of the base member extension 214. A support member 216 is configured to be operatively connected to the base member 212. The support member 216 includes a support plate 220 and a support member extension 219 (e.g., a cylindrical support member extension) that extends downwardly from the support plate 220. The support member 216 includes support member threads (not illustrated) on an interior surface of the support member extension 219 that are configured to threadably engage the base member threads 218 to operatively connect the support member 216 to the base member 212 and more specifically to operatively attach the support member extension 219 to the base member extension 214.

Thus, the support member 216 can be mated directly to base member threads 218 and the members can be rotated relative to each other to adjust the height of the support pedestal 202 (e.g., the base member 212 can be rotated relative to the support member 216, or vice versa). Although illustrated as having internal threads on the support member 216 and external threads on the base member 212, it will be appreciated that other configurations are possible, including external threads on the support member 216 and internal threads on the base member 212.

The support plate 220 is thereby operatively disposed above the base member 212 and may include a top surface 222 with a recess 224 and an outer edge 223 that may be configured to receive and/or be received by the attachment member 400 for use in attaching one or more structural building components 300 to the support pedestal 200, as is described below.

From a broad perspective, the support pedestal 202 may be in the form of a base member plate 215, a support plate 220, and a central section 230 (e.g., a support pillar) extending between the base member plate 215 and the support plate 220. The central section 230 may include the base member extension 214 extending away from the base member plate 215 and a support member extension 219 extending away from the support plate 220. While not shown, the central section 230 may include at least one coupling member (e.g., an extender) extending between the base member extension 214 and the support member extension 219 that operatively attaches the base member extension 214 to the support member extension 219 and that is configured to increase the obtainable height of the support pedestal 200.

In another variation, the central section 230 may be in the form of only a single member which may be cylindrical or non-cylindrical (e.g., square-shaped cross-section). In this regard, the support pedestal 202 may have a fixed height and thus be non-adjustable. It should be appreciated that any discussion herein in relation to the central section 230 may be equally applicable to such other forms of support pillars and central sections. In any event, a distance between the base member plate 215 and the support plate 220 may be, for example, at least about 2 inches but for most applications is typically not greater than about 30 inches. As used herein, the phrase "at least about" encompasses both insubstantial variations of the value (e.g., here, insubstantial variations of 2") as well as the actual value (e.g., here, exactly 2").

Many other types of support pedestals may be utilized in connection with the support pedestal assemblies and support structures disclosed herein. Exemplary support pedestals that may be utilized are disclosed in U.S. Pat. No. 5,588,264 by Buzon, U.S. Pat. No. 6,363,685 by Kugler, U.S. Patent Publication No. 2004/0261329 by Kugler et al.; U.S. Pat. No. 7,921,612 by Knight, III et al.; and U.S. Patent Publication No. 2011/0023385 by Knight, III et al. Further, the support pedestals may be interconnected for increased structural stability, such as in the manner disclosed in U.S. Patent Publication No. 2011/0011012 by Knight, III et al. Each of the foregoing U.S. Patents and U.S. Patent Publications is incorporated herein by reference in its entirety.

As discussed previously, some known elevated building surface support structures are subject to one or more limitations, such as: requiring the structural building components, e.g., the joists, to be milled or otherwise shaped in a specific manner to allow for securement to a support pedestal; lacking the ability to accommodate diverse sizes and numbers of structural building components; lacking the ability to accommodate diverse configurations of structural building components and the like. In this regard, the attachment members disclosed herein are configured to limit or eliminate the degree to which structural building components must be specially shaped or milled for attachment to the attachment member, and may accommodate diverse sizes and orientations of structural building components for use in constructing an elevated building surface support structure.

Broadly stated, and again referring to FIG. 2, the attachment member 400 may include a central portion 404 and at least a first joist attachment structure 436 that is affixed to the central portion 404. For example, the joist attachment structure 436 and the central portion 404 may be fabricated (e.g., molded) as a single, unitary structure. The joist attachment structure 436 includes a first engagement flap 484 disposed proximate a first end 442 of the joist attachment structure 436 and second engagement flap 488 disposed proximate a second end 444 of the joist attachment structure 436 that is opposite the first end 442. As is discussed in more detail below, the first engagement flap 484 and the second engagement flap 488 are each configured to be operatively disposed (e.g., folded) in a substantially orthogonal position, e.g., relative to the top surface 408 of the central portion 404.

Turning now to FIGS. 3-6, an exemplary embodiment of an attachment member 400 includes at least one joist attachment structure 436 having a first engagement flap 484 and a second engagement flap 488 that are configured to be folded upwardly along first foldable support segment 466, and second foldable support segment 468, respectively. In this manner, the engagement flaps 484, 488 may be secured to opposite surfaces of structural building components of numerous sizes and in numerous configurations to attach the structural building components to a support pedestal as part of a support structure.

The attachment member 400 may be fabricated from any appropriate material(s) (e.g., plastics, metals, composites, etc.) and generally includes a central portion 404 having a top surface 408 circumscribed by a peripheral edge 416 of any appropriate shape (e.g., circular, square, rectangular, etc.).

The central portion 404 may include one or more features that are configured to limit movement of the attachment member 400 relative to a support pedestal 200 in one or more directions and/or align the attachment member 400 relative to the support pedestal 200 (see FIG. 2). In one arrangement, and with specific reference to FIGS. 4 and 6, the central portion 404 may include an outer pedestal alignment rim 420 (e.g., continuous or non-continuous projection or ledge of any appropriate shape such as circular, oval, rectangular, etc.) extending from a bottom surface 412 and generally proximate the peripheral edge 416, where the pedestal alignment rim 420 is configured (e.g., shaped and sized) to encompass or receive the support plate 220 of the support pedestal 200 (see FIG. 2).

More particularly, the outer pedestal alignment rim 420 is configured to accept or receive the support plate 220 such that the top surface 222 of the support plate 220 is disposed against or at least towards the bottom surface 412 of the attachment member 400 and such that an inner surface 421 of the outer pedestal alignment rim 420 faces and contacts or is very closely disposed next to the outer edge 223 of the support plate 220 (FIG. 2). For instance, each of the outer pedestal alignment rim inner surface 421 and the support plate outer edge 223 may have a diameter of at least about 2" and not greater than about 8", such as at least about 6" and not greater than about 7". In any event, this configuration may advantageously limit lateral (e.g., side-to-side) shifting of the attachment member 400 relative to the support pedestal 200 (e.g., due to the diameter of the outer pedestal alignment rim inner surface 421 being only slightly greater than that of the support plate outer edge 223) and thus may contribute to limiting the movement of structural building components 300 relative to other structural building components 300. This configuration may also facilitate construction of the support pedestal assembly 200 by assisting with the proper alignment of the attachment member 400 with the support plate 220.

In another arrangement, the central portion 404 may include an inner pedestal alignment rim 424 extending from the bottom surface 412 and disposed within (e.g., having a smaller diameter than) the outer pedestal alignment rim 420. The inner pedestal alignment rim 424 may be sized to be received by the recess 224 in the top surface 222 of the support plate 220 and may be concentric with the outer pedestal alignment rim 420. Similarly, this arrangement may advantageously reduce lateral shifting of the attachment member 400 relative to the support pedestal 200 due to the diameter of the inner pedestal rim 424 being only slightly smaller than that of the recess 224 in the top surface 222 of the support plate 220. In some arrangements, the inner pedestal rim 424 may be sized to matingly accept the outer edge of a support plate that is smaller than that which can be matingly accepted by the outer pedestal rim 420. In this regard, the attachment member 400 may advantageously be mated to a number of support pedestals 200 having variously sized support plates.

Although not shown, some arrangements envision one or more additional pedestal rims designed to appropriately engage with a support pedestal for limiting movement of the attachment member 400 relative to the support pedestal in one or more directions. Furthermore, some arrangements envision that the support plate 220 of the support pedestal 202 may include one or more support plate rims extending away from the top surface 222 that are adapted to be received in one or more corresponding recesses or apertures in the bottom surface 412 of the attachment member 400 to similarly limit movement of the attachment member 400 relative to the support pedestal 200.

The central portion 404 may include at least one pedestal fastener aperture 428 disposed therein (e.g., extending between the top and bottom surfaces 408, 412) and sized to operatively receive a mechanical fastener (e.g., bolt, self-tapping screw, etc.). For instance, upon disposing the bottom surface 412 of the central portion 404 over and/or against the top surface 222 of the support plate 220 (either with or without the outer and/or inner pedestal rims 420, 424 interacting with the support plate 220), a mechanical fastener may be disposed through the pedestal fastener aperture 428 and at least partially through the top surface 222 of the support plate 220 to affix (e.g., removably affix) the attachment member 400 to the support pedestal 202 and thereby limit lateral and axial (i.e., up and down) movement of the attachment member 400 relative to the support pedestal 202. In one variation, an aperture reinforcement rim 430 may extend from the bottom surface 412 of the central portion 404 proximately surrounding the pedestal fastener aperture 428 for use in maintaining the structural integrity of the top surface 408 of the central portion 404 after a fastener has been inserted through pedestal fastener aperture 428 and tightened to secure the attachment member 400 to a support pedestal 202. That is, the aperture reinforcement rim 430 may advantageously prevent the top surface 408 from becoming non-planar (e.g., concave) when a mechanical fastener secures (e.g., tightens) the attachment member 400 to the support pedestal 202.

Figure 4:
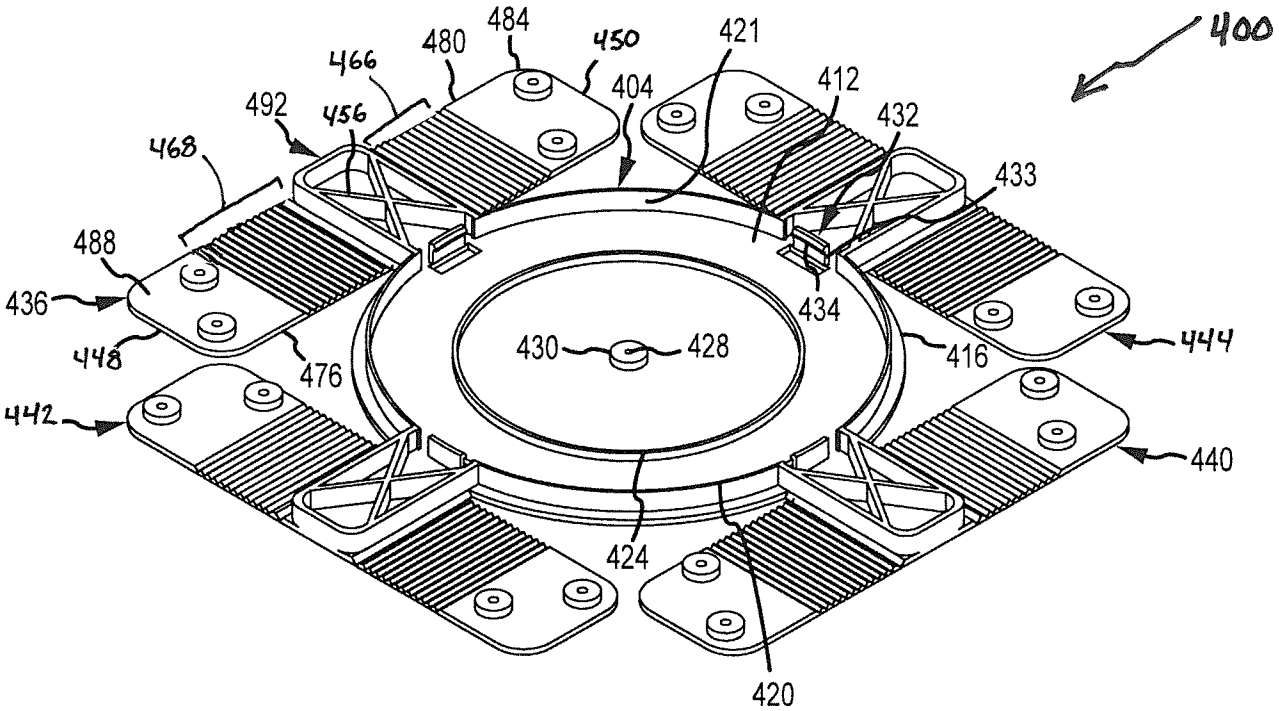
FIG. 4 illustrates a lower perspective view of the attachment member of FIG. 3.
Figure 5:
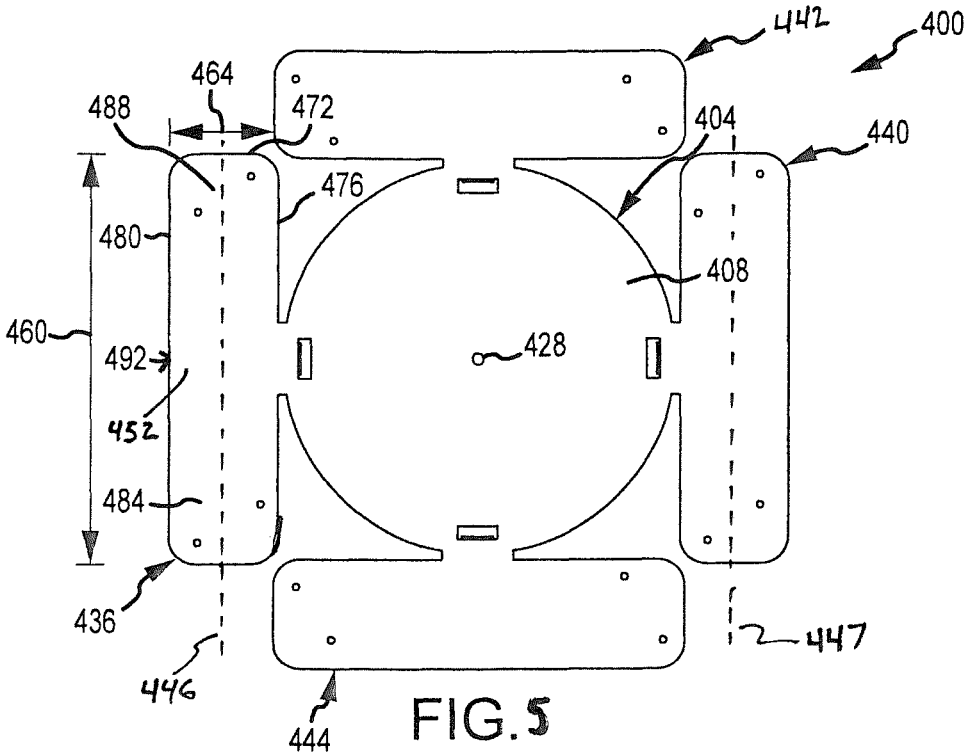
FIG. 5 illustrates a top plan view of the attachment member of FIG. 3.
Figure 6:
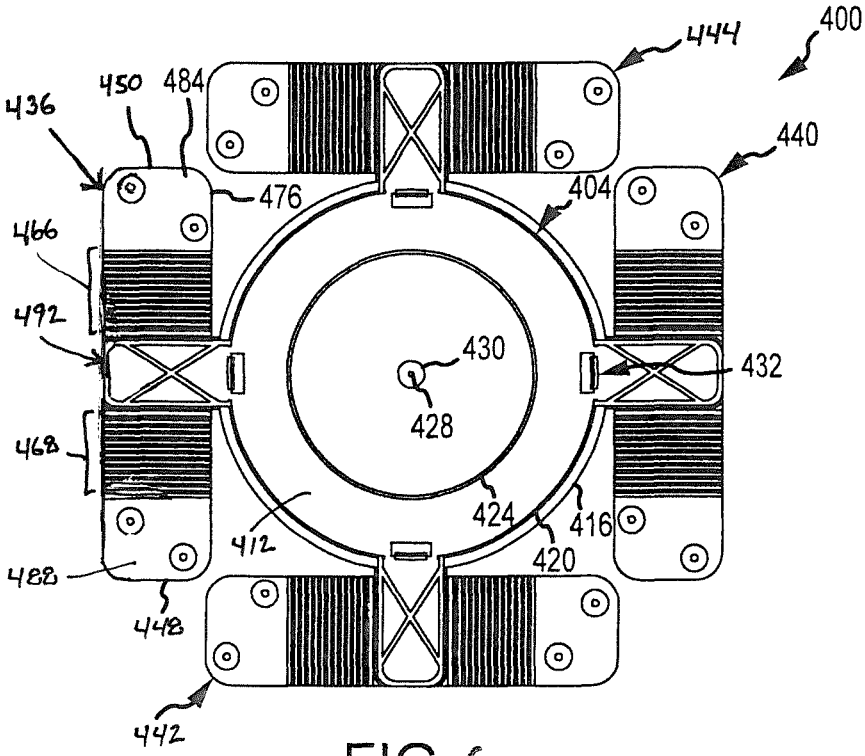
FIG. 6 illustrates a bottom plan view of the attachment member of FIG. 3.

In a further arrangement, the central portion 404 may include one or more attachment clips such as locking members 432 extending from the bottom surface 412 and configured to flex or snap around the outer edge 223 of the support plate 222 to at least removably interconnect or secure the attachment member 400 to the support pedestal 202 (e.g., to restrict lateral and axial movement of the attachment member 400 relative to the support pedestal 202). For example, each locking member 432 may include a resilient arm 433 and a protuberance 434 that is adapted to deflect initially away from a center of the central portion 404 (e.g., in a radial direction) upon the protuberance 434 engaging with the outer edge 223 of the support plate and then substantially return to an initial position (e.g., as shown in FIG. 4) whereby the protuberance 434 is disposed generally against or opposed a bottom surface of the support plate 220. Each locking member 432 may generally be configured to restrict both lateral and axial movement of the attachment member 400 relative to the support pedestal 202. When used in conjunction with an outer pedestal alignment rim 420 (e.g., as shown in FIG. 4), each locking member 432 may be arranged or oriented so that an imaginary projective line extending through the outer pedestal rim 420 also extends through each locking member 432 (i.e., each locking member 432 may be at least substantially collinear with the outer pedestal rim 420).

With continued reference to FIGS. 3-6, the attachment member 400 includes at least a first joist attachment structure 436 extending outwardly from or otherwise operatively affixed (e.g., permanently or detachably) to the central portion 404 of the attachment member 400. The joist attachment structure 436 includes a first engagement flap 484, and a second engagement flap 488 that are each configured to be disposed in a substantially orthogonal position relative to the top surface 408 of the attachment member 400 and/or relative to a top surface 432 of a joist support arm 492. More specifically, the joist attachment structure 436 is configured to enable the engagement flaps 484 and 488 to be folded against and secured to the opposite surfaces of structural building components 300 of numerous sizes and in numerous configurations to attach the structural building components 300 to a support pedestal 202 as part of a support pedestal assembly 200. The attachment member 400 may additionally include several additional joist attachment structures, such as second, third and fourth joist attachment structures 440, 442, 444 having a structure that is substantially the same or similar to the first joist attachment structure 436. In one characterization, and as illustrated in FIGS. 3-6, the first and second joist attachment structures 436, 440 may be separated by about 180° along a peripheral edge 416 of the central portion 404 and may be in substantially parallel alignment (e.g., the longitudinal axes 446 and 447 of the first and second joist attachment structures 436 and 440 may be substantially parallel). The third joist attachment structure 442 and the fourth joist attachment structure 444, may be similarly separated by about 180° along the peripheral edge 416 of the central portion 404 and may be in substantially parallel alignment, and the third and fourth joist attachment structures 442, 444, may be orthogonally disposed relative to the first and second joist attachment structures 436, 440. Other arrangements and orientations of greater or fewer numbers of joist attachment structures are also envisioned and encompassed within the present disclosure. While specific features and components of the first joist attachment structure 436 will now be described, similar discussion may apply to other joist attachment structures of the attachment member 400 (e.g., such as the second, third and fourth joist attachment structures 440, 442 and 444).

The first joist attachment structure 436 includes attachment structure length 460 (FIG. 5) extending from a first end 448 to a second end 450 and an attachment structure width 464 extending from a proximal edge 476 to a distal edge 480. The first joist attachment structure 436 also includes a first engagement flap 484, and a second engagement flap 488 respectively disposed at first and second ends 448, 450 (e.g., proximate the first and second ends) and a joist support arm 492 disposed between the first and second engagement flaps 484, 488. Each of the first and second engagement flaps 484, 488 is readily foldable (e.g., selectively foldable) along a first foldable support segment 466 and a second foldable support segment 468, respectively, from at least a first flap position, e.g., one that is substantially co-planar with the top surface 408 of the central portion 404 and/or with the top surface 452 of the joist support arm 492 (e.g., as in FIGS. 4-6) to a second engagement flap position that is substantially orthogonal to the top surface 408 of the central portion 404 and/or with the top surface 452 of the joist support arm 492 (e.g., as in FIG. 3). In this latter configuration, the first and second engagement flaps 484, 488 may be affixed to one or more structural building components 300 in any appropriate manner (e.g., fasteners, adhesive, etc. . . . ). The first and second engagement flaps 484, 488 may also be affixed to one or more structural building components 300 in engagement flap positions other than those that are substantially orthogonal to the top surface of the central portion or the joist support arm, depending upon a particular cross-sectional shape of the structural building component(s) 300.

Figure 7:
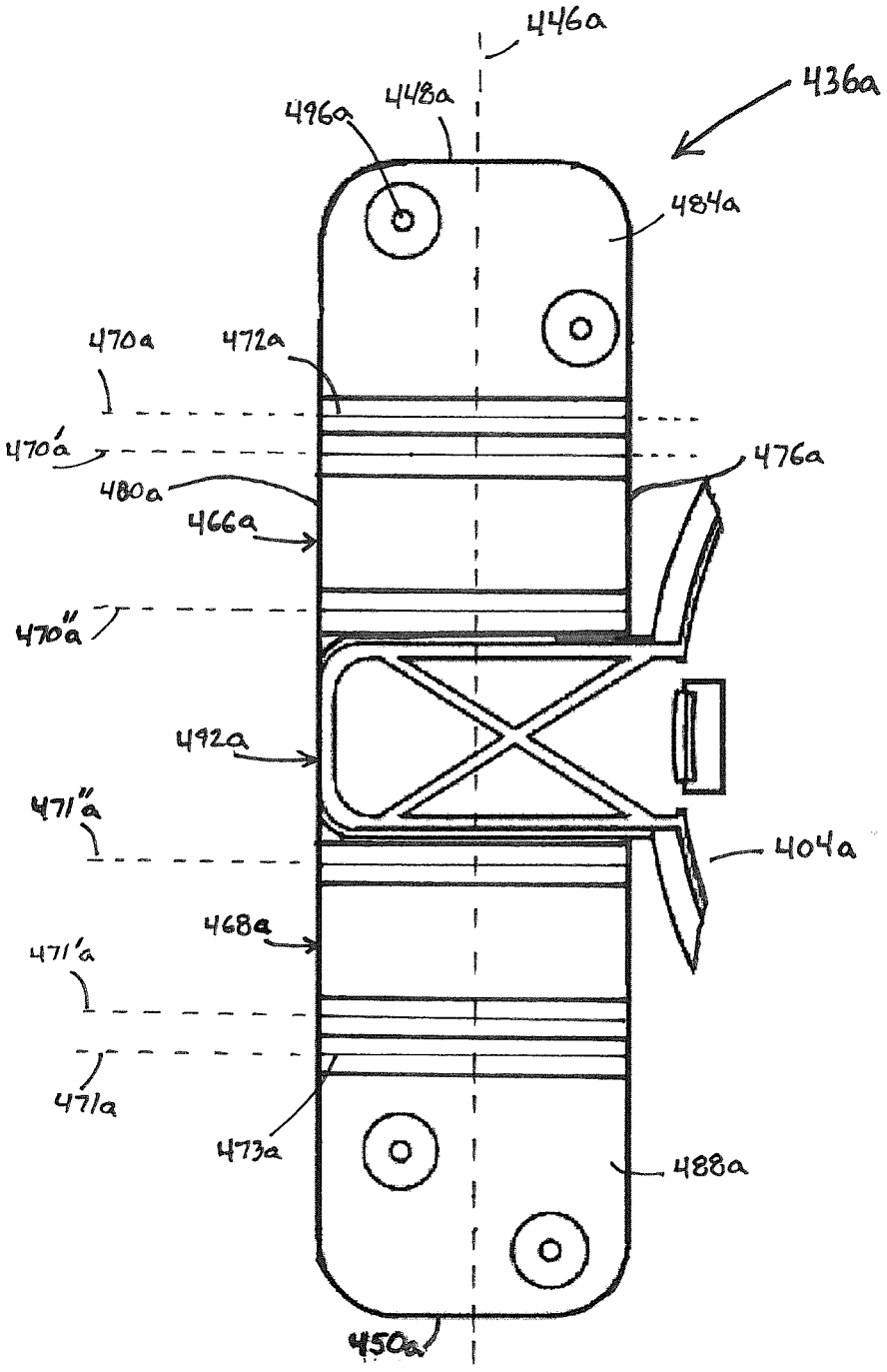
FIG. 7 illustrates a bottom plan view of a joist attachment structure according to one embodiment.

FIG. 7 illustrates a bottom plan view of a joist attachment structure 436*a* in accordance with one embodiment. The joist attachment structure 436*a* includes a first engagement flap 484*a* disposed at a first end 448*a* of the joist attachment structure 436*a*. A second engagement flap 488*a* is disposed at a second end 450*a* of the joist attachment structure 436*a*, opposite the first end 448*a*. The first engagement flap 484*a* and the second engagement flap 488*a* are configured to be disposed in a substantially orthogonal position relative to the top surface of the central portion of the attachment member. In this regard, each of the first and second engagement flaps 484*a*, 488*a* are upwardly foldable, e.g., from a first engagement flap position to a substantially orthogonal position. As illustrated in FIG. 7, the joist attachment structure 436*a* includes a joist support arm 492*a* that is rigidly affixed to the central portion 404*a* of the attachment member. A first foldable support segment 466*a* is disposed between the joist support arm 492*a* and the first engagement flap 484*a*. Likewise, a second foldable support segment 468*a* is disposed between the joist support arm 492*a* and the second engagement flap 488*a*. Each of the first and second foldable supports segments 466*a*, 468*a* include at least a first foldable support segment pivot axis 470*a* and 471*a* that are configured to enable the first and second engagement flaps 484*a*, 488*a* to be folded (e.g., selectively folded) upwardly along the foldable support segment pivot axes 470*a*, 471*a*.

As illustrated in FIG. 7, the engagement flap pivot axes 470*a* and 471*a* each comprise grooves 472*a* and 473*a* formed on a bottom surface 488*a* of the joist attachment arm 436*a* and that extend from a proximal edge 476*a* (e.g., proximal to the central portion) to a distal edge 480*a* of the foldable support segments. Thus, the pivot axes 470*a* and 471*a* are substantially orthogonally disposed relative to a longitudinal axis 446*a* of the joist attachment structure 436*a*.

As illustrated in FIG. 7, each foldable support segment 466*a* and 468*a* includes three pivot axes e.g., three grooves along which each engagement flap may be folded. Thus, foldable support segment 466*a* includes three pivot axes (470*a*, 470'*a* and 470"*a*) and the foldable support segment 468*a* includes pivot axes 471*a*, 471'*a* and 471"*a*. Stated another way, the joist attachment structure 446*a* includes three pair of pivot axes, namely pivot axis pairs 470*a*/471*a*, 470'*a*/471'*a* and 470"*a*/471"*a*. Each pivot axis in a pivot axis pair may be spaced substantially equidistant from the joist support arm 492*a* so that the engagement flaps may be affixed to a structural building component when the building component width is substantially centered on the joist support arm 492*a*. Thus, the joist attachment structure 436*a* may accommodate at least three different widths of a structural building component.

Figure 8:
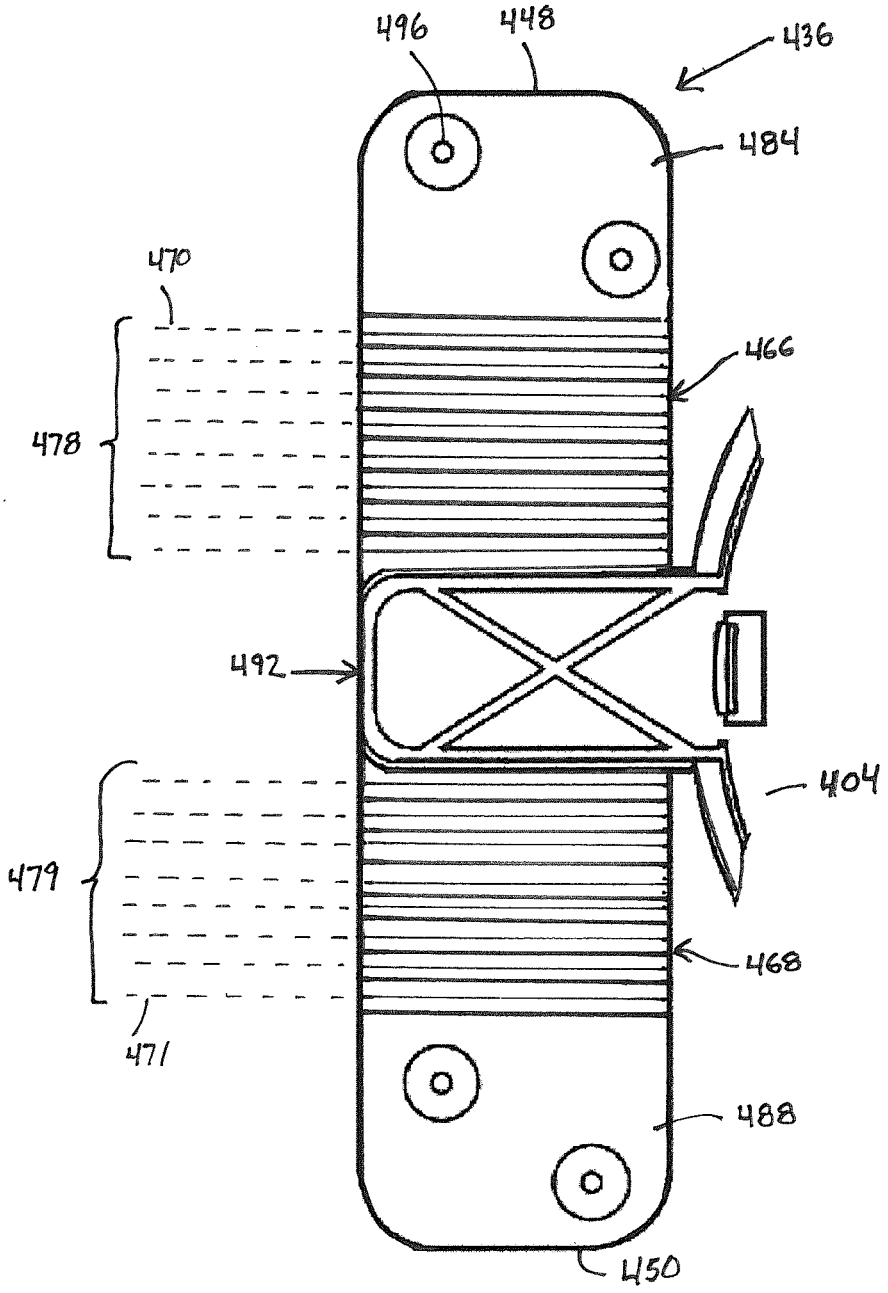
FIG. 8 illustrates a bottom plan view of joist attachment structure according to another embodiment.

FIG. 8 illustrates a bottom plan view of another joist attachment structure 436, such as the joist attachment structure illustrated in FIGS. 3-6. The joist attachment structure 436 includes a first engagement flap 484 disposed at a first end 448 of the joist attachment structure 436. A second engagement flap 488 is disposed at a second end 450, opposite the first end 448. Each of the first and second engagement flaps 484, 488 are foldable from a first engagement flap position to another engagement flap position, e.g., a substantially orthogonal position. A joist support arm 492 is rigidly affixed to the central portion 404 of the attachment member. A first foldable support segment 466 is disposed between the joist support arm 492 and the first engagement flap 484, and a second foldable support segment 468 is disposed between the joist support arm 492 and the second engagement flap 488.

In the embodiment illustrated in FIG. 8, each of the first and second foldable support segments 466, 468 includes a plurality of pivot axes 478, 479 (e.g., pivot axis 470 and pivot axis 471) that are configured to enable the first and second engagement flaps 484, 488 to be folded upwardly (e.g., toward a structural building component) along any of the pivot axes. Thus, the bottom surface of the first and second foldable support segments 466, 468 may be characterized as being serrated or sawtoothed along a length of the foldable support segments 466, 468 so that a plurality of pivot axes 478, 479 are provided. In one characterization, the foldable support segments may comprise at least about 2 pivot axes per inch, such as at least about 4 pivot axes per inch, at least about 6 pivot axes per inch and even at least about 8 pivot axes per inch, such as at least about 10 pivot axes per inch. In this manner, many different sizes (e.g., different widths) of structural building components may be operatively affixed to the joist attachment structure 436 using the engagement flaps 484, 488.

Figure 9A:
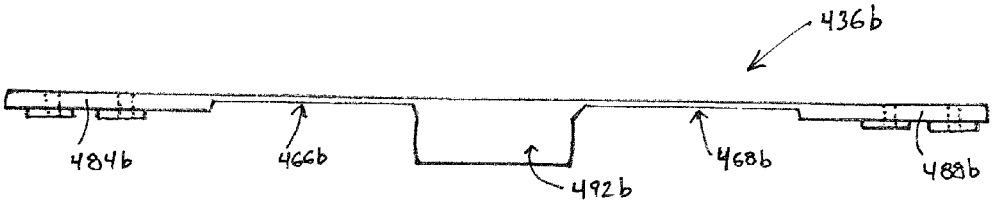
FIGS. 9A-9C illustrate side views of three joist attachment structures.
Figure 9B:
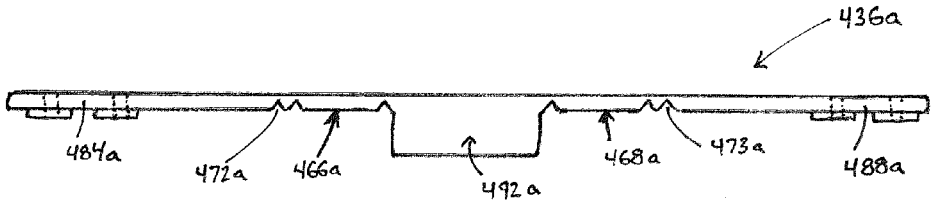
Figure 9C:
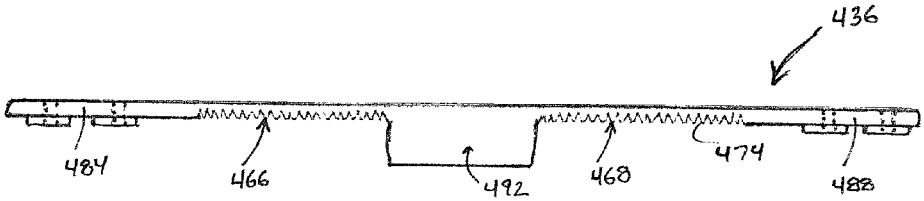

FIGS. 9A-9C illustrate side views of several different embodiments of a joist attachment structure. FIG. 9A illustrates a joist attachment structure 436*b* where the foldable support segments 466*b* and 468*b* are defined by a thinned-out portion of the joist attachment structure 436*b*. That is, the foldable support segments 466*b*, 468*b* are thinner (e.g., have a decreased cross-section or thickness) as compared to the engagement flaps 484*b* and 488*b* and the joist support arm 492*b*. In this manner, the engagement flaps 484*b* and 488*b* may be folded upwardly at any point along the length of the lengths of the foldable support segments 466*b* and 468*b*.

FIG. 9B illustrates a side view of the joist attachment member 436*a* illustrated in FIG. 7. As illustrated in FIG. 9B, each of the foldable support segments 466*a* and 468*a* include a plurality of grooves (e.g., grooves 472*a* and 473*a*) that define pivot axes along which the first and second engagement flaps 484*a*, 488*a* may be folded. As is discussed with respect to FIG. 7, pairs of grooves (e.g., grooves 472*a*/473*a*) may be spaced substantially equidistant from the joist support arm 492*a* on opposite sides of the joist support arm 492*a*.

FIG. 9C illustrates a side view of the joist attachment member 436 illustrated in FIG. 8. In this embodiment, the foldable support segments 466 and 468 comprise a plurality of serrations 474 along a length of the foldable support segments 466, 468. These serrations 474 advantageously enable the first engagement flap 484 and the second engagement flap 488 to be folded upwardly at a plurality of different positions along a length of the first and second foldable support segments 466, 468 and therefore enable the accommodation of building components of varying sizes (e.g., varying widths).

Figure 10A:
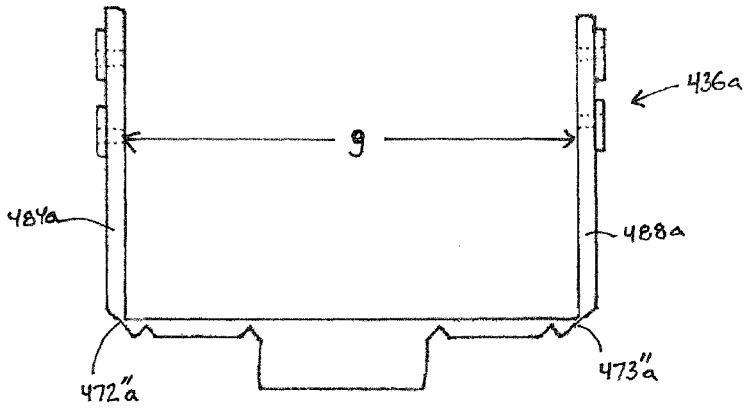
FIGS. 10A-10C illustrate side views of a joist attachment structure in three different configurations.
Figure 10B:
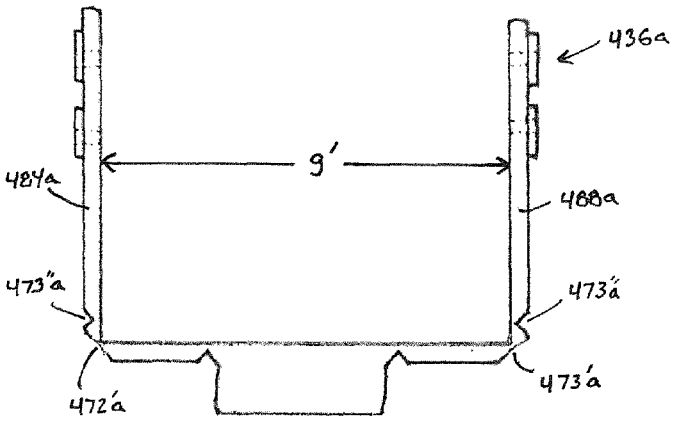
Figure 10C:
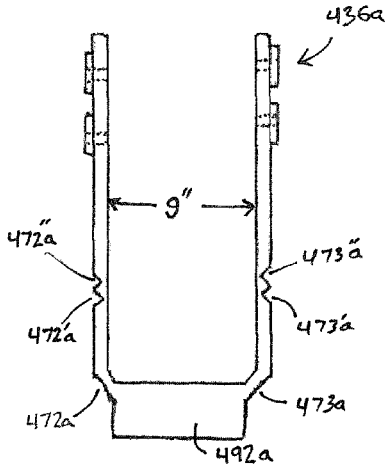

FIGS. 10A-10C illustrate the joist attachment structure 436*a* (e.g., FIGS. 7 and 9B) in various configurations, i.e., where the engagement flaps 484*a*, 488*a* are folded upwardly at different positions (e.g., different pivot axes) along the length of the foldable support segments. As illustrated in FIG. 10A, the engagement flaps 484*a* and 488*a* are folded upwardly along a first pair of grooves 472"*a* and 473"*a*. In this manner, a gap width g is defined between the two engagement flaps 484*a* and 488*a* for accommodating a building component, or plurality of adjacent building components, having a width approximately equal to g.

In FIG. 10B, the engagement flaps 484*a* and 488*a* are foldable upwardly along a second pair of grooves 472'*a* and 473'*a*. As a result, a gap width g' is defined between the two engagement flaps 484*a* and 488*a*. The gap width g' is less than the gap width g illustrated in FIG. 10A. In FIG. 10C, the engagement flaps 484*a* and 488*a* have been folded upwardly along a third pair of grooves 472*a* and 473*a* that are adjacent to the joist support arm 492*a*. Thus, a gap width g" is defined that is less than the gap width g'.

In one exemplary characterization, the gap width g may be about 3.5", e.g., such as to accommodate a nominal 4×4 piece of lumber. Further, the gap width g' may be about 3", e.g., to accommodate a pair of adjacent nominal 2×4 pieces of lumber. The gap width g" may be about 1.5", e.g., to accommodate a single 2×4 piece of lumber having a nominal width of 1.5". It will be appreciated that the foregoing constitute but one example, and that fewer or more gap widths of greater of smaller widths may be provided.

Figure 11A:
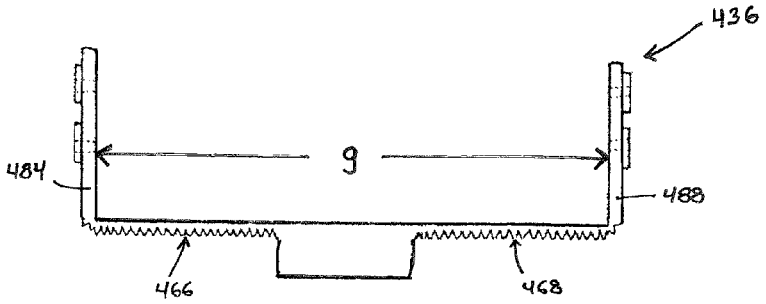
FIGS. 11A-11C illustrate side views of another joist attachment structure in three different configurations.
Figure 11B:
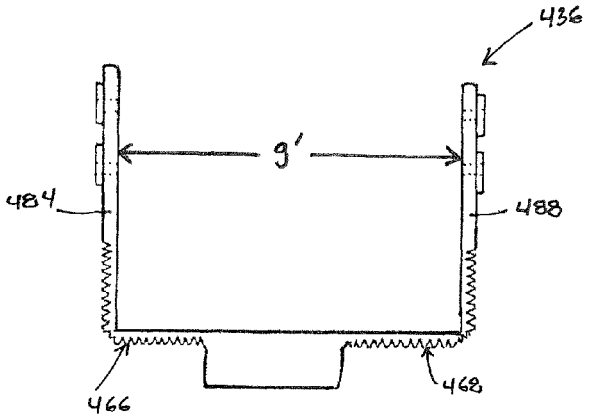
Figure 11C:
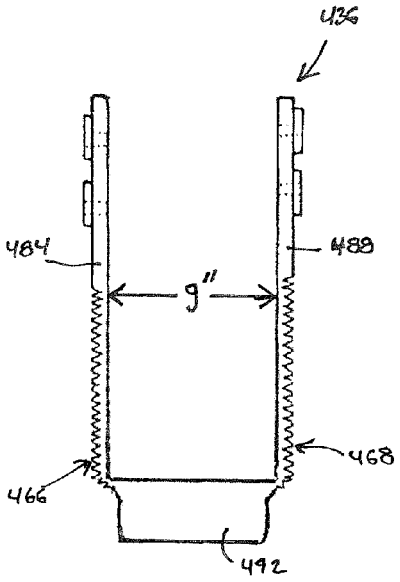

FIGS. 11A-11C illustrate the joist attachment structure 436 (e.g., FIGS. 3-6) in various configurations, i.e., where the engagement flaps 484, 488 are folded upwardly at different positions (e.g., different pivot axes) along the length of the foldable support segments 466 and 468. As illustrated in FIG. 11A, the first engagement flap 484 and the second engagement flap 488 are folded along a pivot axis that is adjacent to the engagement flaps 484 and 488. Thus, a gap width g is defined between the first and second engagement flaps 484, 488. As illustrated in FIG. 11C, the first and second engagement flaps 484 and 488 are folded along pivot axes that are disposed adjacent to the joist support arm 492 to define a minimum gap width g" between the first and second engagement flaps.

FIG. 11B illustrates the first and second engagement flaps 484 and 488 being folded along a pivot axis of the foldable support segments 466 and 468 between the maximum and minimum gap widths g and g". Thus, a gap width g' is defined between the two engagement flaps 484 and 488. It will be appreciated from FIG. 11B that the first and second engagement flaps 484 and 488 may be folded along virtually any point along the length of the foldable support segment 466 and 468. As is discussed above, although building support structures such as wooden lumber are provided with nominal listed dimensions, the actual building components may have dimensions that vary slightly from these nominal dimensions. It is a particular advantage of the joist attachment structure 436 illustrated in FIGS. 11A-11C that a wide range of gap widths between maximum gap width g and minimum gap width g" may be defined between the two engagement flaps 484*a* and 488*a* to accommodate such variations.

For instance, the pivot axes of the foldable support segments may be configured to provide a gap width to accommodate or receive one or more structural building components, such as a pair of 2×4s having a combined actual width of about 3" (i.e., the distance between the pivot axes may be at least about 3"). Of course, the pivot axes are also operable to receive a single structural building component having at least one dimension of, in the above example, 3". As another example, the pivot axes may be spaced to accommodate or receive a particular width dimension of a structural building component, such as a width of a nominal 2×4 or 2×6 having an actual width of about 1½" (i.e., the distance between the pivot axes may be at least about 1½"). Numerous other arrangements and numbers of pivot axes to accommodate varying numbers and sizes of structural building components are also envisioned and included within the scope of the present disclosure.

It can thus be seen and appreciated how the attachment members may accommodate structural building components of various sizes and dimensions without requiring the structural building components to be specially milled or otherwise shaped. That is, one or more building support components may be disposed over one or more joist attachment structures, and the respective first and second engagement flaps of the one or more joist attachment structures may be folded upwardly towards the building support component(s) and affixed thereto (e.g., with a fastener) without the need for special notches, openings, and the like in the structural building component(s). While grooves and/or serrations are illustrated as being disposed in the bottom surface of the joist attachment structures, other arrangements additionally or alternatively envision disposing or forming the serrations (and/or other features) in a top surface of the joist attachment structure.

Figure 12:
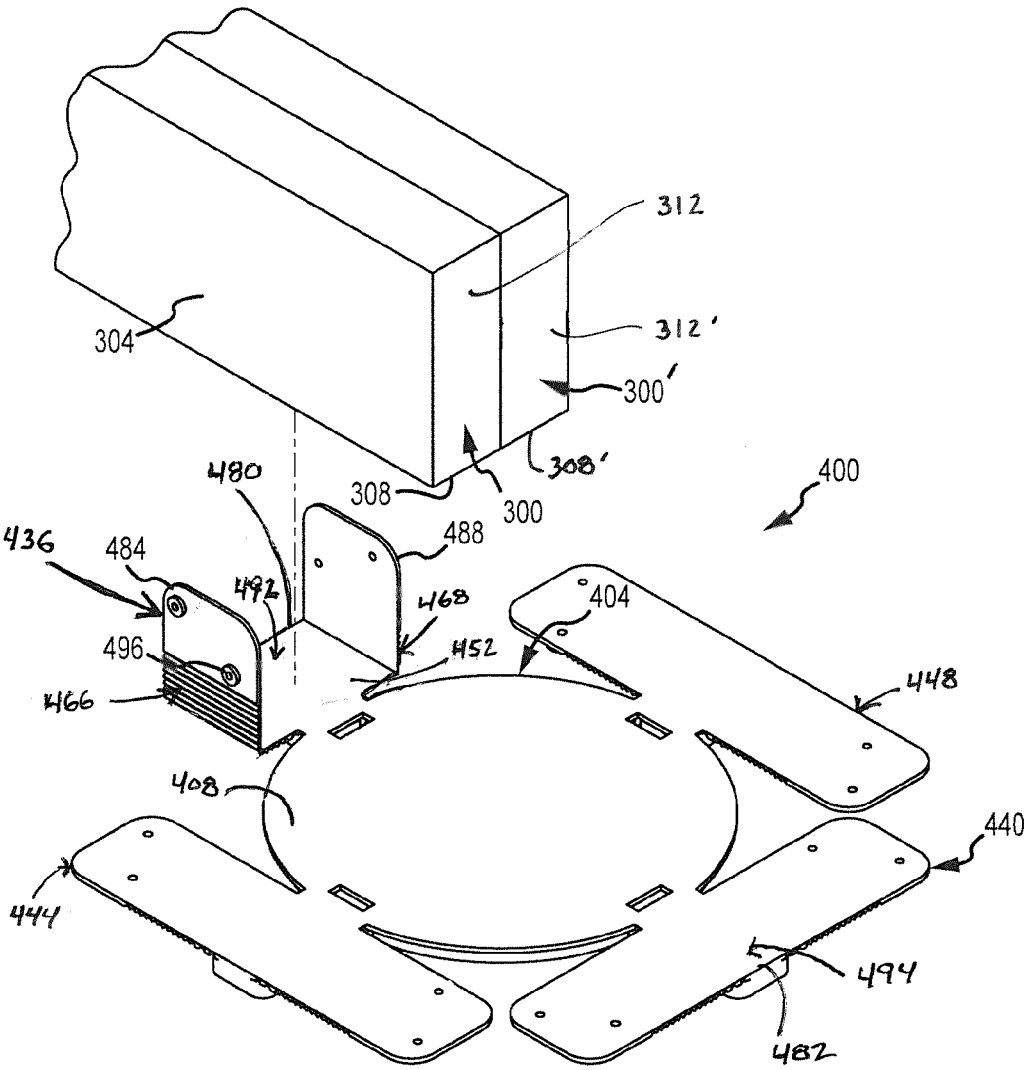
FIG. 12 illustrates an upper perspective view of the attachment member of FIG. 3 with a pair of adjacent structural building components in position to be attached to the joist attachment structure of the attachment member.

FIG. 12 illustrates a pair of structural building components 300, 300' disposed over a joist attachment structure 436 between the first and second engagement flaps 484, 488 that have been folded along first and second foldable support segments 466 and 468. In this manner, the structural building components 300, 300' may be operatively disposed on the joist attachment structure 436 (e.g., at least on the joist support arm 492) and be disposed within a gap formed between the first engagement flap 484 and the second engagement flap 488 (see, FIG. 11B). To provide for enhanced structural stability, the top surface 408 of the central portion 404 may be configured to be substantially co-planar with the top surface 452 of the joist support arm 492. In this regard, a substantial entire length of the attachment member 400 from the distal edge 480 of one joist support arm (e.g., the first joist support arm 492) to the distal edge 480 of an opposing joist support arm (e.g., the second joist support arm 494) may be in flush contact with a corresponding surface (e.g., bottom surfaces 308, 308') of one or more structural building components 300, 300'.

FIG. 12 also illustrates that structural building components 300, 300' may be arranged so that their bottom surfaces 308 and 308' are disposed over the support portion 492 of the first joist attachment structure 436 and their end surfaces 312 and 312' are disposed over the central portion 404. One or more of the second, third and fourth joist support structures 440, 444, 448 may accommodate other structural building components in a similar manner. In this regard, the attachment member 400 may advantageously accommodate the intersection of four structural building components, such as at angles of 90° between adjacent structural building components.

Figure 13:
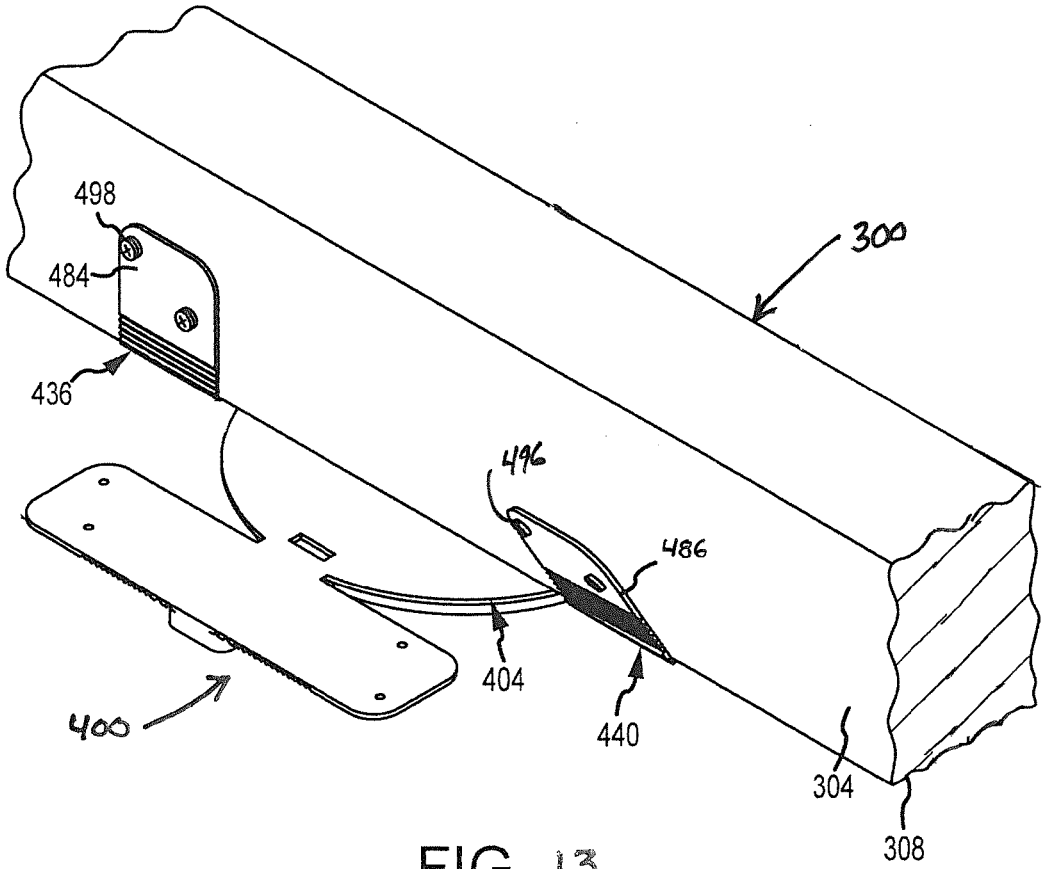
FIG. 13 illustrates an upper perspective view of the attachment member of FIG. 3 with a structural building component disposed on the attachment member, where one pair of engagement flaps is affixed to the structural building component and an opposite pair of engagement flaps is folded partially upward.

FIG. 13 illustrates a structural building component 300 that is disposed on an attachment member 400 and between a first engagement flap 484 and a second engagement flap (not visible) of the first joist attachment structure 436 and between the first engagement flap 486 and a second engagement flap (not visible) of the joist attachment structure 440. As shown in FIG. 13, the first engagement flap 484 of the first joist support attachment 436 has been affixed (e.g., fastened) to a side surface 304 of the structural building component 300. The other engagement flaps of the joist support structures 436, 440 may be similarly fastened to the structural building component 300. For instance, the engagement flaps may each include at least one fastener aperture 496 that is sized to receive a mechanical fastener 498 (e.g., nail, screw, bolt). More specifically, the mechanical fastener 498 may be passed and/or threaded through a fastener aperture 496 of at least one of the first and second engagement flaps and into the structural building component 300 to secure the structural building component 300 to the attachment member 400, which itself may be disposed on (e.g., attached to) a support pedestal (e.g., as in FIG. 1). Additionally or alternatively, other manners of affixing the engagement flaps to the one or more structural building components are also envisioned, such as through the utilization of adhesives, clips, and the like.

FIG. 13 also illustrates how a single structural building component 300 may be disposed across the entire attachment member 400, including the joist attachment structures 436 and 440.

Figure 14:
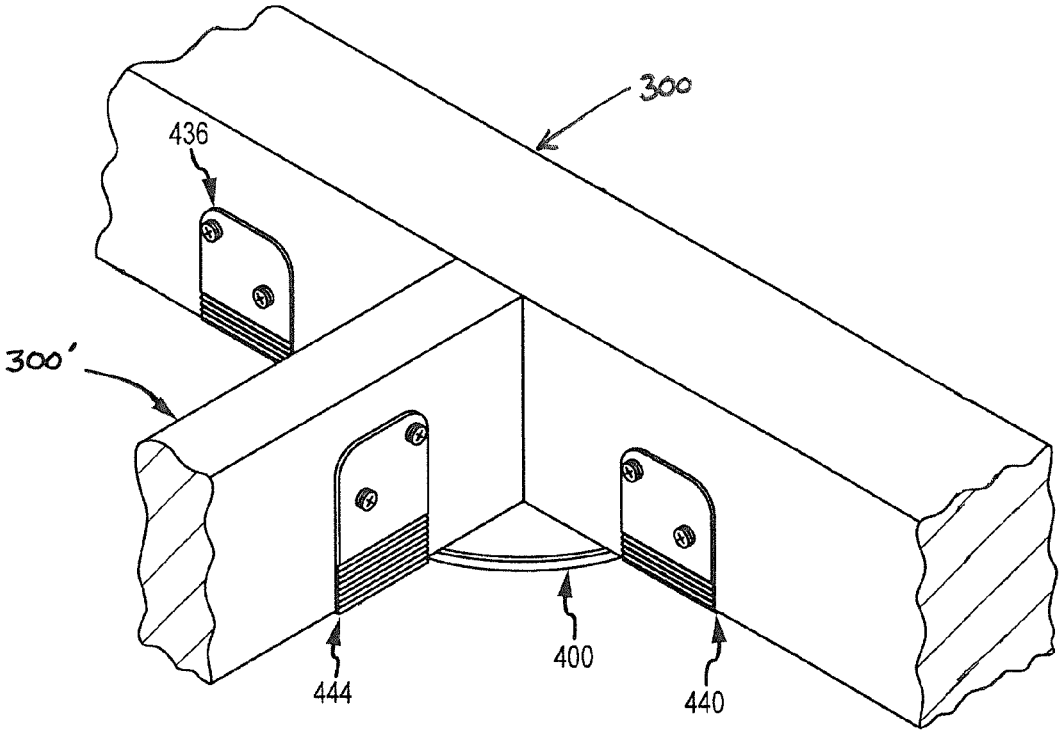
FIG. 14 illustrates an upper perspective view of the attachment member of FIG. 3 with a first structural building component disposed upon the attachment member, where first and second pairs of engagement flaps are affixed to the first structural building component, where a second structural building component is disposed at about 90° to the first of structural building component, and where a third pair of engagement flaps is affixed to the second structural building component.

FIG. 14 illustrates how another structural building component 300' may be accommodated by the attachment member 400, such as by the joist attachment structure 444 at an angle (e.g., 90°) relative to the structural building component 300. FIG. 14 also illustrates that the same pairs of pivot axes need not be used among the various joist support structures of the attachment member 400. It will also be appreciated that an additional structural building component may be accommodated by the attachment member 400 on the opposite side of the building component 300.

Figure 15:
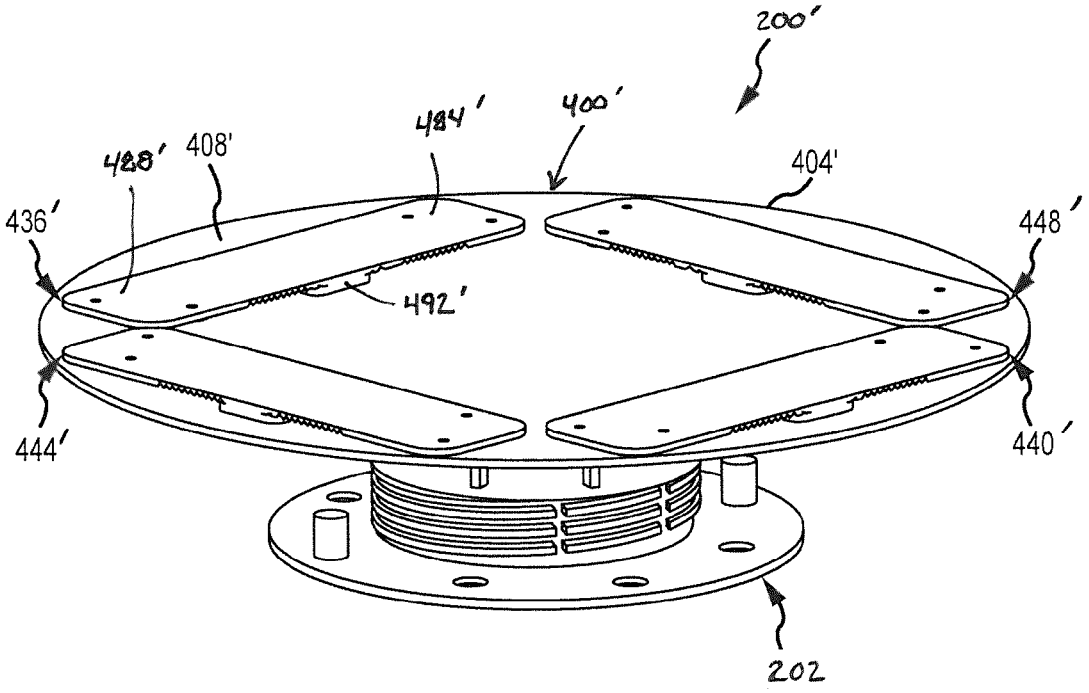
FIG. 15 illustrates an upper perspective view of a support pedestal assembly including an alternative embodiment of an attachment member operatively disposed on the support pedestal, where the joist attachment structures are at least partially disposed on a top surface of a central portion of the attachment member.

FIG. 15 illustrates an upper perspective view of an alternative embodiment of a support pedestal assembly 200' that includes an attachment member 400' disposed over a support pedestal 202. In this embodiment, the first, second, third and fourth joist support structures 436', 440', 444', 448' are at least partially disposed on the top surface 408' of the central portion 404'. That is, the top surface 408' of the central portion 404' is sized to at least partially accommodate the joist support structures. In this regard, the joist support arms (e.g., joist support arm 492' may be affixed to the top surface 408' of the central portion 404). This arrangement may advantageously enhance the durability of the attachment member 400' and the ability of the attachment member 400' to support a number of structural building components (e.g., joists).

Figure 16:
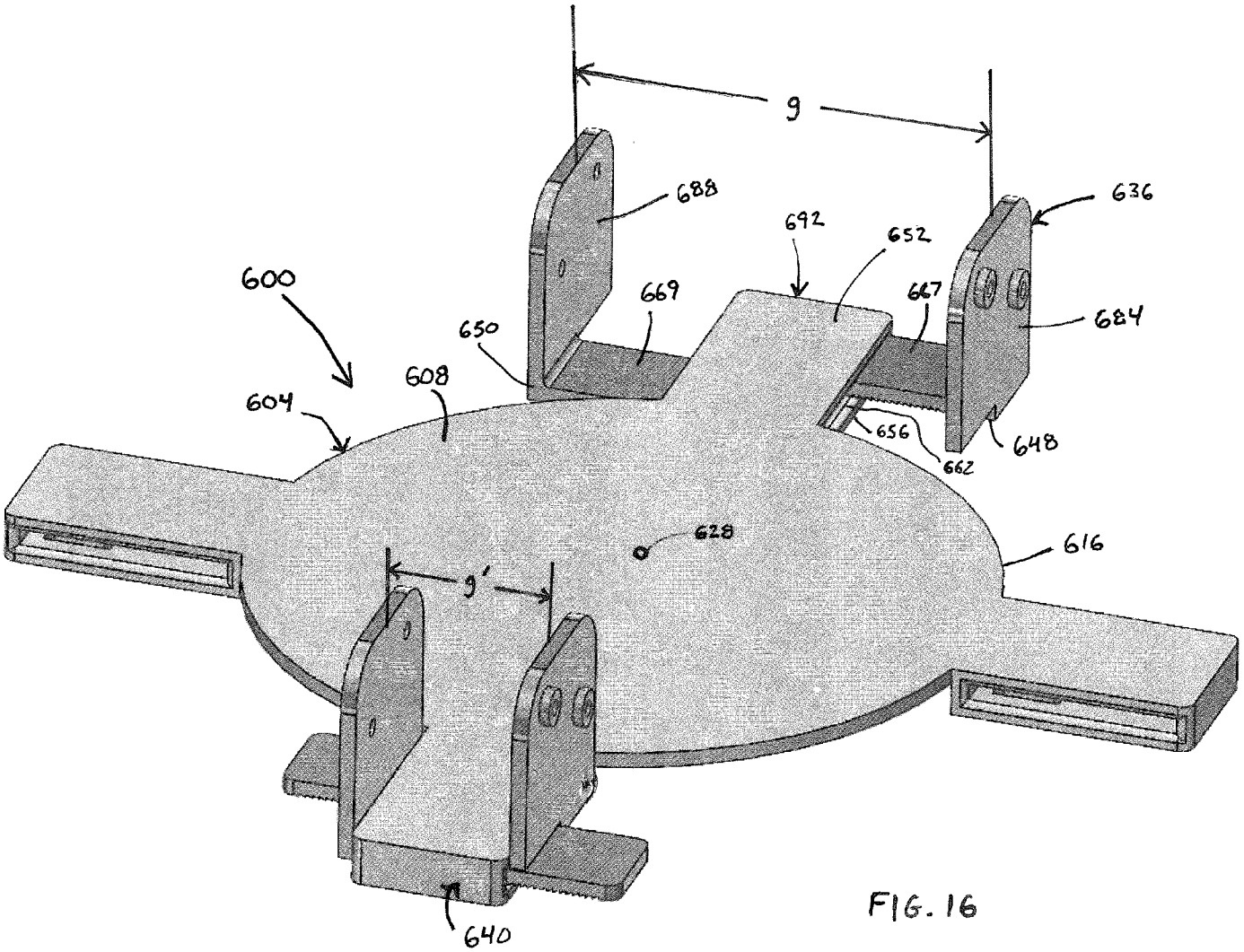
FIG. 16 illustrates an upper perspective view of an alternative embodiment of an attachment member.
Figure 17:
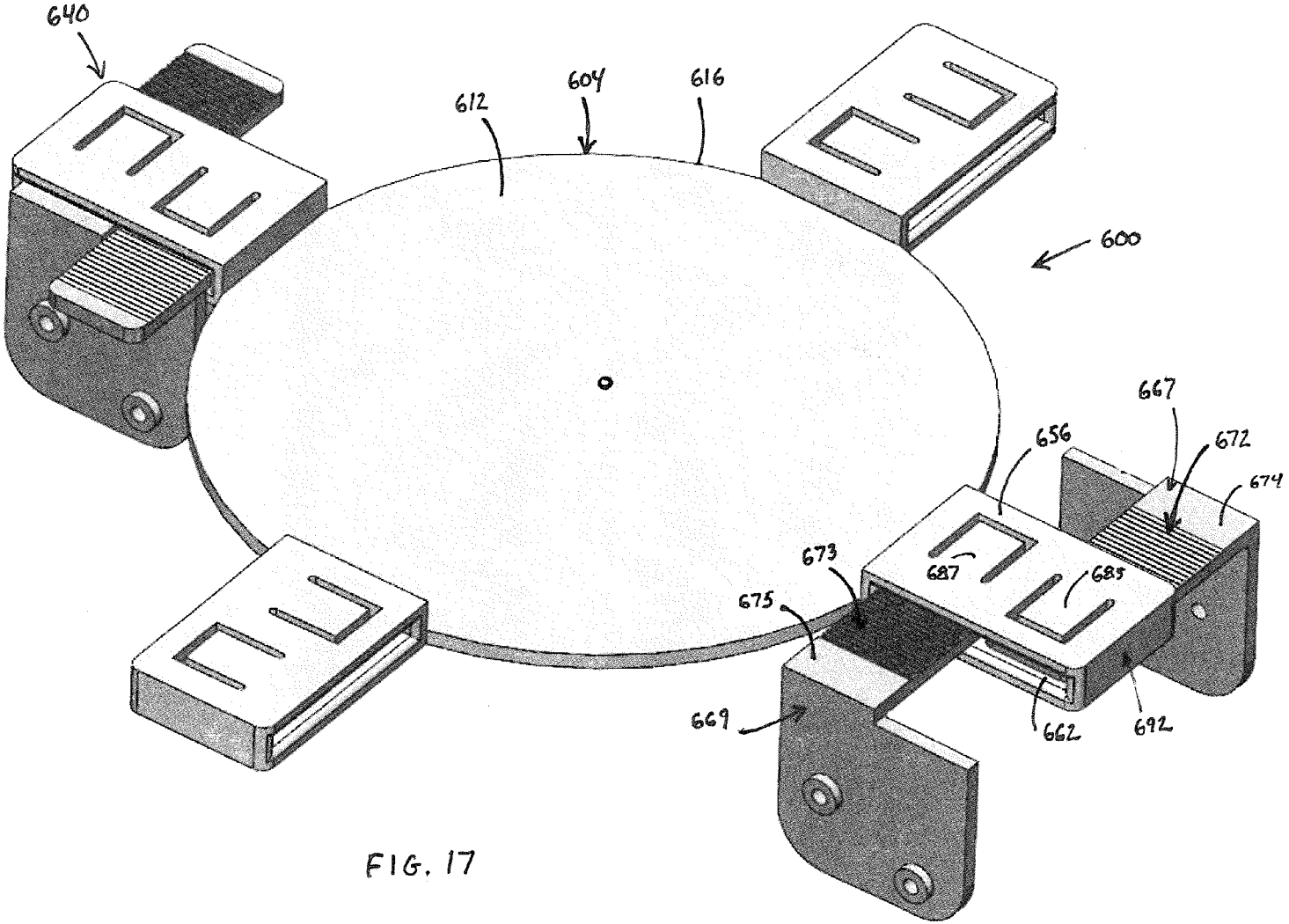
FIG. 17 illustrates a bottom perspective view of the attachment member illustrated in FIG. 16.
Figure 18:
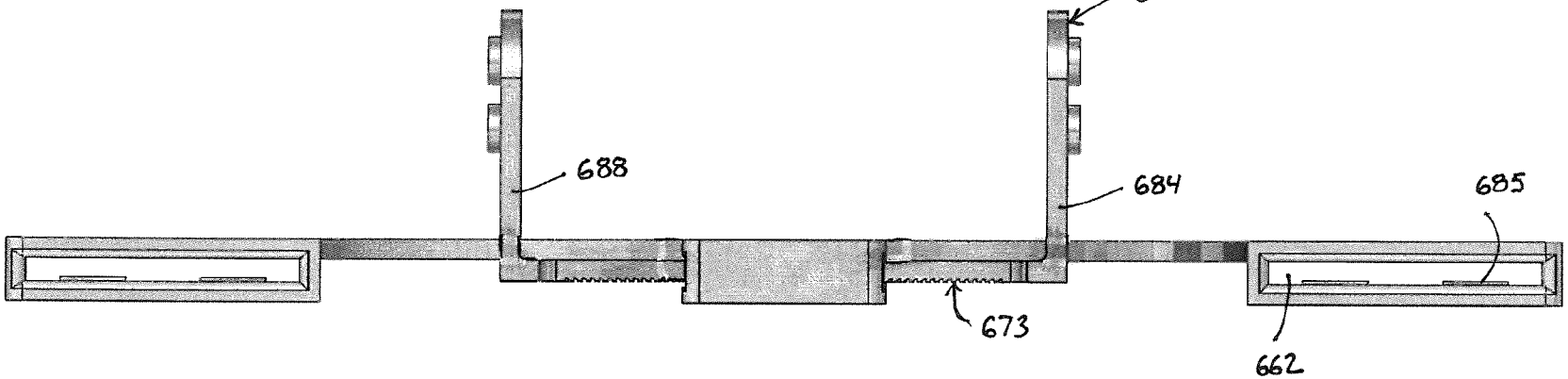
FIG. 18 illustrates a side view of the attachment member illustrated in FIG. 13.

FIGS. 16-18 illustrate an alternative embodiment of an attachment member 600. The attachment member 600 includes at least one joist attachment structure 636 having a first engagement flap 684 and a second engagement flap 688 disposed on opposite sides of a joist support arm 692. The first engagement flap 684 and the second engagement flap 688 are configured to be disposed in a substantially orthogonal position, e.g., relative to a top surface 608 of the central portion 604 of the attachment member 600. In one characterization, and as illustrated in FIGS. 16-18, the engagement flap 684 and 688 are rigidly affixed to first and second slidable support segments 667, 669, respectively in such an orthogonal position. Alternatively, the engagement flaps 684, 688 may be foldable, e.g., along a pivot axis where the engagement flaps are attached the slidable support segments 667, 669.

In either case, the engagement flap 684 and 688 may be manipulated by linearly sliding the slidable support segments 667, 669 to provide a gap distance (e.g., a first gap distance g) between the first engagement flap 684 and second engagement flap 688. For example, the slidable support segments 667 and 669 may be further manipulated to provide a minimum gap width g', such as illustrated for joist attachment structure 640 in FIGS. 16 and 17.

The joist support arm 692 may be rigidly affixed to the central portion 604 of the attachment member 600. The joist support arm may include a top surface 692 that is substantially coplanar with the top surface 608 of the central portion 604. The joist support arm 692 may also include a bottom surface 656, wherein a cavity 662 is disposed between the top surface 652 and the bottom surface 656. In this manner, the slidable support segments 667 and 669 are at least partially disposed within the cavity 662.

Referring to FIG. 17, the first slidable support segment 667 includes a bottom surface 674. A plurality of serrations 672 may be disposed on the bottom surface 674. The serrations 672 are configured to engage with a locking tab member 685 disposed on a bottom surface 656 of the joist support arm 692 and extending into the cavity 662. In this manner, the locking tab member 685 is configured to engage with the serrations 672 and restrict non-desirable movement of the slidable support segment 667. Although not illustrated in FIG. 17, the bottom surface 612 of the central portion 604 may include structures (e.g., pedestal alignment rims) such as those illustrated and described with respect to FIGS. 4 and 6.

Figure 19:
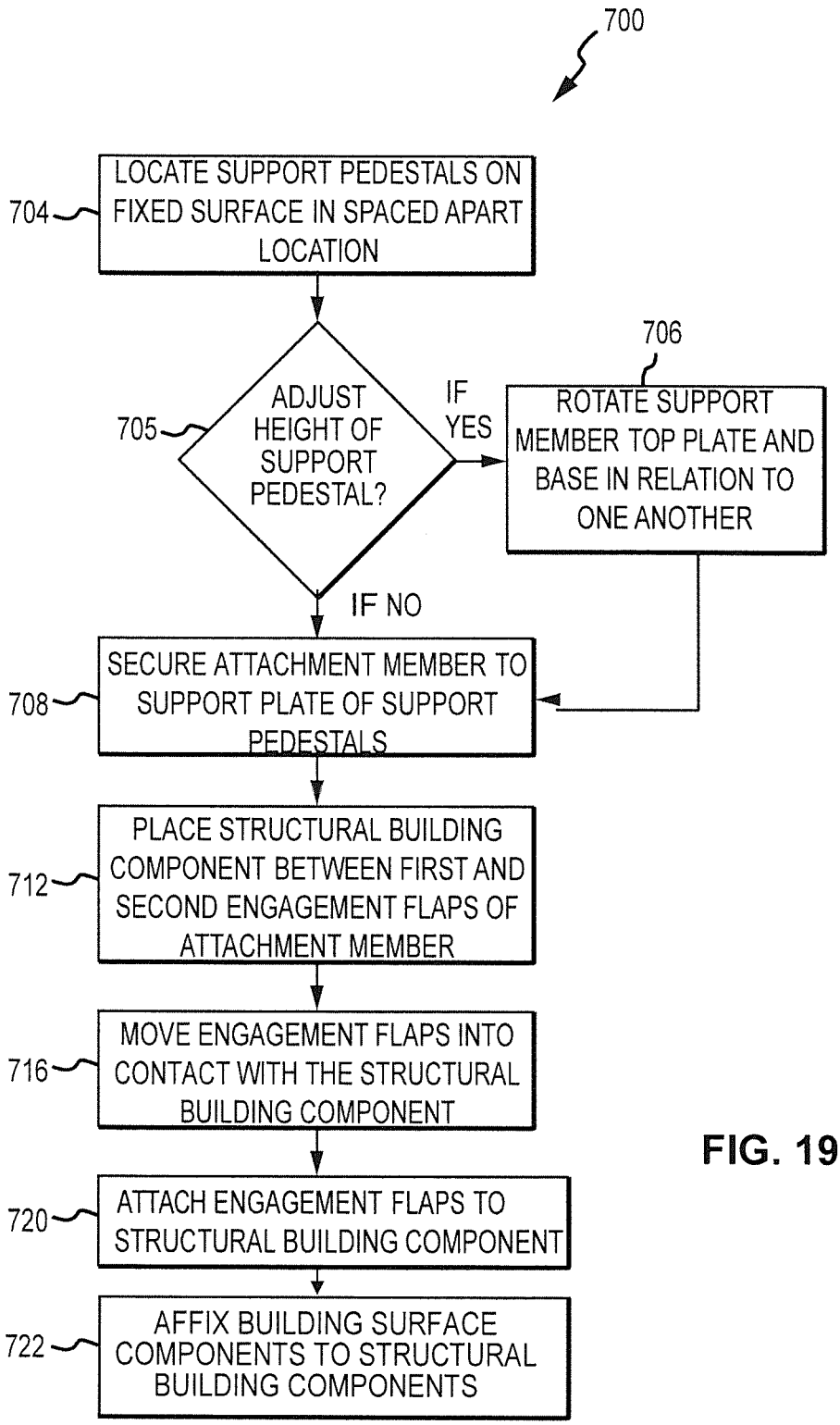
FIG. 19 illustrates a method for constructing an elevated building support structure such as that of FIG. 1.

FIG. 19 illustrates a method 700 for constructing an elevated building surface assembly (e.g., the elevated building surface assembly 100 of FIG. 1). The method 700 may include locating 704 a plurality of support pedestals on a fixed surface in spaced-apart locations and determining 705 whether a height of one or more of the support pedestals needs to be adjusted. In response to a positive determination at 705, the method 700 may proceed to rotate 706 the support member top plate and the base member in relation to one another. In any case, the method 700 may eventually proceed to secure 708 attachment members to the support plates of the support pedestals (e.g., see FIGS. 2 and 15) to form support pedestal assemblies that include the support pedestal and the attachment member. For example, the attachment member may be secured to the support plates using a mechanical fastener such as a screw.

The method 700 may also include placing 712 one or more structural building components (e.g., joists), between one or more pairs of first and second engagement flaps of the various attachment members, moving 716 the first and second engagement flaps towards the structural building components (e.g., by folding or sliding the engagement flaps), and attaching 720 the first and second engagement flaps to the structural building components (e.g., using a mechanical fastener) to securely attach the structural building components to the support pedestals. In some arrangements, each of the various attachment members may accommodate or receive additional structural building components by way of moving pairs of third and fourth engagement flaps, where the third and fourth engagement flaps may be equivalent to the first and second engagement flaps of a third support arm to contact such additional structural building components.

After the structural building components (e.g., joists) are attached to the engagement flaps, and hence to the support pedestals through the attachment members, the method may proceed to affixing 722 building surface components (e.g., planks) to the structural building components to form the elevated building surface assembly.

In relation to FIG. 19, it should be understood that at least some steps may be performed in an order other than that shown (e.g., in some embodiments, steps 705 and 706 may be performed after step 708). Furthermore, it should be understood that the use of "first," "second," "third," etc. in relation to various components throughout this discussion are merely arbitrary labels used to assist the reader in understanding the various aspects of the present embodiments and arrangements.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. An attachment member for securing a structural building component to a support pedestal, the attachment member comprising:

a central portion comprising a top surface disposed in a plane and a bottom surface circumscribed by a peripheral edge; and at least a first joist attachment structure affixed to the central portion and extending outwardly beyond the peripheral edge, the first joist attachment structure comprising:

a first engagement flap disposed at a first end of the first joist attachment structure, wherein the first engagement flap is disposed in a plane; and a second engagement flap disposed at a second end of the first joist attachment structure opposite the first end, wherein the second engagement flap is disposed in a plane;

wherein the plane of the first engagement flap is configured to be disposed in a substantially orthogonal position relative to the plane of the top surface of the central portion, and wherein the plane of the second engagement flap is configured to be disposed in a substantially orthogonal position relative to the plane of the top surface of the central portion.

2. The attachment member recited in claim 1, wherein the first and second engagement flaps may be moved relative to a longitudinal axis of the joist attachment structure to provide a first gap distance along the longitudinal axis and between the inner flap surfaces and at least a second gap distance along the longitudinal axis and between the inner flap surfaces that is greater than the first gap distance.

3. The attachment member recited in claim 2, wherein each of the first and second engagement flaps is foldable from a first engagement flap position to the substantially orthogonal position.

4. The attachment member recited in claim 3, wherein the first engagement flap position is substantially co-planar with the top surface of the central portion.

5. The attachment member recited in claim 3, wherein the first joist attachment structure comprises:

a joist support arm rigidly affixed to the central portion of the attachment member;

a first foldable support segment disposed between the joist support arm and the first engagement flap; and a second foldable support segment disposed between the joist support arm and the second engagement flap, wherein the first and second foldable support segments each comprise at least a first foldable support segment pivot axis configured to enable the first and second engagement flaps to be folded upwardly along the foldable support segment pivot axes.

6. The attachment member recited in claim 5, wherein the engagement flap pivot axes comprise grooves that extend from a proximal edge of the first joist attachment structure to a distal edge of the first joist attachment structure and that are disposed substantially orthogonally to the longitudinal axis of the first joist attachment structure.

7. The attachment member recited in claim 3, wherein the central portion and the first joist attachment structure are fabricated as a single unitary structure.

8. The attachment member recited in claim 2, wherein the first and second engagement flaps are attached to slidable support segments that are linearly slidable along the longitudinal axis of the first joist attachment structure.

9. The attachment member recited in claim 8, wherein the first and second engagement flaps are rigidly affixed in the substantially orthogonal position to the slidable support segments.

10. The attachment member recited in claim 8, wherein the first joist attachment structure comprises:

a joist support arm rigidly affixed to the central portion of the attachment member, the joist support arm comprising an upper surface that is substantially co-planar with the top surface of the central portion, a lower surface, and a cavity disposed between the upper and lower surfaces, wherein the slidable support segments are at least partially disposed within the cavity.

11. The attachment member recited in claim 1, wherein the attachment member comprises a second joist attachment structure affixed to the central portion and extending outwardly beyond the peripheral edge, the second joist attachment structure comprising:

a first engagement flap having an inner flap surface and that is disposed at a first end of the second joist attachment structure; and a second engagement flap having an inner flap surface and that is disposed at a second end of the joist attachment structure opposite the first end;

wherein when the first and second engagement flaps are disposed in a substantially orthogonal position relative to the top surface of the central portion, the inner flap surface of the first engagement flap lies in a plane that is substantially parallel to a plane within which the inner flap surface of the second engagement flap lies, and wherein the inner flap surfaces define a gap therebetween.

12. The attachment member recited in claim 11, wherein the peripheral edge of the central portion is substantially circular and wherein the first joist attachment structure is separated from the second joist attachment structure by about 180 degrees along the peripheral edge.

13. The attachment member recited in claim 11, wherein the attachment member comprises at least a third joist attachment structure and a fourth joist attachment structure extending outwardly beyond the peripheral edge of the central portion.

14. The attachment member recited in claim 2, wherein the first gap distance is at least about 1 inch and the second gap distance is at least about 3 inches.

15. The attachment member recited in claim 2, wherein the first and second engagement flaps may be moved to provide at least a third gap distance that is greater than the first gap distance and is less than the second gap distance.

16. The attachment member recited in claim 1, wherein the joist attachment structure comprises at least a first fastener aperture disposed in each of the first and second engagement flaps.

17. The attachment member recited in claim 1, wherein the attachment member comprises a pedestal fastener aperture disposed in the central portion.

18. The attachment member recited in claim 17, wherein the attachment member comprises an aperture reinforcement rim extending from the bottom surface of the central portion and proximately surrounding the pedestal fastener aperture.

19. The attachment member recited in claim 18, wherein the attachment member comprises a pedestal alignment rim extending from the bottom surface of the central portion, wherein the pedestal alignment rim has a larger diameter than the aperture reinforcement rim.

20. The attachment member recited in claim 19, wherein the attachment member comprises at least one clip extending from the bottom surface of the central portion, wherein the clip is configured to attach to a support pedestal when the attachment member is placed on a top surface of the support pedestal.

21. The attachment member recited in claim 20, wherein the clip is substantially collinear with the pedestal alignment rim.

22. The attachment member recited in claim 1, wherein the attachment member is fabricated from at least one of plastic and metal.

23. The attachment member recited in claim 1, wherein the plane of the first engagement flap is substantially parallel to the plane of the second engagement flap, and wherein the and the inner flap surfaces of the first and second engagement flaps define a gap therebetween.

24. The attachment member recited in claim 1, wherein the peripheral edge of the central portion is substantially circular.

25. The attachment member recited in claim 1, wherein a substantial entirety of the first joist attachment member is disposed outside of the peripheral edge of the central portion.

26. An attachment member for securing a structural building component to a support pedestal, the attachment member comprising:

a central portion comprising a top surface and a bottom surface circumscribed by a peripheral edge; and at least first and second joist attachment structures affixed to the central portion and extending beyond the peripheral edge, each of the joist attachment structures comprising, a first engagement flap disposed at a first end of the joist attachment structure, a second engagement flap disposed at a second end of the joist attachment structure opposite the first end, a first foldable support segment disposed adjacent to the first engagement flap and comprising a first foldable support segment pivot axis, and a second foldable support segment disposed adjacent to the second engagement flap and comprising a second foldable support segment pivot axis, wherein the first and second engagement flaps are upwardly foldable along the first and second foldable support segment pivot axes from a first flap position to a second flap position that is substantially orthogonal relative to the top surface of the central portion.

27. The attachment member recited in claim 26, wherein the first and second joist attachment structures are disposed on the top surface of the central portion.

28. The attachment member recited in claim 26, wherein the first and second joist attachment structures extend outwardly from the peripheral edge of the central portion.

29. The attachment member recited in claim 28, wherein the central portion and the first and second joist attachment structures are fabricated as a single unitary structure.

30. The attachment member recited in claim 28, wherein a first gap distance between respective inner flap surfaces of the first and second engagement flaps is provided in the substantially orthogonal position, and wherein at least a second gap distance between the respective inner flap surfaces of the first and second engagement flaps is provided in the substantially orthogonal position that is greater than the first gap distance.

31. The attachment member recited in claim 30, wherein the first gap distance is at least about 1 inch and the second gap distance is at least about 3 inches.

32. The attachment member recited in claim 28, wherein the pivot axes comprise grooves disposed on a bottom surface of the first and second joist attachment structures.

33. The attachment member recited in claim 32, wherein each of the foldable support segments comprises at least 3 foldable support segment pivot axes.

34. The attachment member recited in claim 28, wherein each of the first and second foldable support segments comprises a corrugated surface defining a plurality of foldable support segment pivot axes.

35. The attachment member recited in claim 28, wherein the first and second joist attachment structures comprise a joist support arm rigidly affixed to the central portion of the attachment member and disposed between the first and second foldable support segments.

36. The attachment member recited in claim 28, wherein the attachment member comprises at least a first fastener aperture disposed in each of the first and second engagement flaps.

37. The attachment member recited in claim 28, wherein the attachment member is fabricated from at least one of plastic and metal.

38. An attachment member for securing a structural building component to a support pedestal, the attachment member comprising:

a central portion comprising a top surface and a bottom surface circumscribed by a peripheral edge; and at least first and second joist attachment structures affixed to the central portion, each of the joist attachment structures comprising, a first engagement flap disposed at a first end of the joist attachment structure wherein the first engagement flap is attached to a first slidable support segment that is linearly slidable along a longitudinal axis of the first slidable support segment, and a second engagement flap disposed at a second end of the joist attachment structure opposite the first end wherein the second engagement flap is attached to a second slidable support segment that is linearly slidable along a longitudinal axis of the second slidable support segment wherein for each of the first and second joist attachment structures, the first and second engagement flaps may be manipulated by linearly sliding the first and second slidable support segments to provide at least first and second different gap distances between the first and second engagement flaps.

39. The attachment member recited in claim 38, wherein the first and second engagement flaps are rigidly affixed in a substantially orthogonal position relative to the first and second slidable support segments, respectively.

40. The attachment member recited in claim 38, wherein the first and second joist attachment structures each comprise:

a joist support arm rigidly affixed to the central portion of the attachment member, the joist support arm comprising an upper surface that is substantially co-planar with the top surface of the central portion, a lower surface, and a cavity disposed between the upper and lower surfaces, wherein the slidable support segments are at least partially disposed within the cavity.

41. A support pedestal assembly, comprising:

a support pedestal comprising a base plate that is adapted to be placed on a fixed surface, a support plate that is configured to support a building surface component, and a central section extending between the base plate and the support plate; and an attachment member operatively disposed on the support plate, the attachment member comprising, a central portion disposed over the support plate and comprising a top surface and a bottom surface circumscribed by a peripheral edge, and at least first and second joist attachment structures affixed to the central portion, each of the joist attachment structures comprising, a first engagement flap having an inner flap surface that is disposed at a first end of the joist attachment structure; and a second engagement flap having an inner flap surface that is disposed at a second end of the joist attachment structure opposite the first end;

wherein when the first and second engagement flaps are disposed in a substantially orthogonal position relative to the top surface of the central portion, the inner flap surface of the first engagement flap lies in a plane that is substantially parallel to a plane within which the inner flap surface of the second engagement flap lies to define a gap therebetween; and wherein the first joist attachment structure is affixed to a first side of the central portion, wherein the second joist attachment structure is affixed to a second side of the central portion, and wherein the first side of the central portion is opposite to the second side of the central portion.

42. The support pedestal assembly recited in claim 41, wherein the joist attachment structures are configured to be manipulated to provide a first gap distance between the first and second engagement flaps in the substantially orthogonal position and at least a second gap distance that is greater than the first gap distance.

43. The attachment member recited in claim 42, wherein each of the first and second engagement flaps is foldable from a first engagement flap position to the substantially orthogonal position.

44. The attachment member recited in claim 43, wherein the first engagement flap position is substantially co-planar with the top surface of the central portion.

45. An elevated building support structure, comprising:

a plurality of support pedestals disposed in spaced-apart relation on a fixed surface, the support pedestals comprising a base plate that is placed on the fixed surface, a support plate, and a central section extending between the base plate and the support plate;

an attachment member disposed on the support plate, the attachment member comprising, a central portion disposed over the support plate and comprising a top surface and a bottom surface circumscribed by a peripheral edge, and at least first and second joist attachment structures affixed to the central portion, each of the joist attachment structures comprising, a first engagement flap disposed at a first end of the joist attachment structure; and a second engagement flap disposed at a second end of the joist attachment structure opposite the first end; and at least one structural building component secured to the attachment member, wherein the first and second engagement flaps of at least one of the joist attachment structures are each disposed in a position that is substantially orthogonal to the top surface of the support member, and wherein the first and second engagement flaps are affixed to opposite sides of the at least one structural building component.

46. The elevated building support structure recited in claim 45, wherein the structural building component is a joist.

47. The elevated building support structure recited in claim 45, wherein the first and second joist attachment structures comprise support arms that extend outwardly from the central portion of the attachment member.

48. The elevated building support structure recited in claim 45, wherein the first and second joist attachment structures are at least partially disposed on the top surface of the central portion of the attachment member.

49. The elevated building support structure recited in claim 45, wherein at least one of the attachment member and the support pedestals is fabricated from plastic.

50. The elevated building support structure recited in claim 45, wherein at least one of the attachment member and the support pedestal is fabricated from metal.

* * * * *